US006314697B1

(12) United States Patent
Moore, Jr.

(10) Patent No.: US 6,314,697 B1
(45) **Date of Patent: *Nov. 13, 2001**

(54) CONCRETE FORM SYSTEM CONNECTOR LINK AND METHOD

(76) Inventor: James D. Moore, Jr., 513 Coconut Isle, Ft. Lauderdale, FL (US) 33301

( * ) Notice: Subject to any disclaimer, the term of this patent is extended or adjusted under 35 U.S.C. 154(b) by 0 days.

This patent is subject to a terminal disclaimer.

(21) Appl. No.: 09/426,572

(22) Filed: Oct. 25, 1999

Related U.S. Application Data

(60) Provisional application No. 60/105,598, filed on Oct. 26, 1998.

(51) Int. Cl.[7] ..... E04B 2/00

(52) U.S. Cl. ..... 52/426

(58) Field of Search ..... 52/426, 427, 428

(56) References Cited

U.S. PATENT DOCUMENTS

| | | | |
|---|---|---|---|
| 718,429 | 1/1903 | Conway . | |
| 963,776 | 7/1910 | Kosack . | |
| 1,053,231 | 2/1913 | Schweikert . | |
| 1,069,821 | 8/1913 | Sherwood et al. . | |
| 1,953,287 | 4/1934 | Bemis . | |
| 1,973,941 | 9/1934 | Anderson . | |
| 2,029,082 | 1/1936 | Odam . | |
| 2,248,348 | 7/1941 | Hall . | |
| 2,316,819 | 4/1943 | Tedrow . | |
| 2,750,648 | 6/1956 | Hallock . | |
| 2,911,818 | 11/1959 | Smith . | |
| 3,286,428 | 11/1966 | Kay | 52/496 |
| 3,475,873 | 11/1969 | Steadman | 52/293 |
| 3,612,470 | 10/1971 | Troy et al. | 249/19 |
| 3,782,049 | 1/1974 | Sachs | 52/309 |
| 3,788,020 | 1/1974 | Gregori | 52/309 |

(List continued on next page.)

FOREIGN PATENT DOCUMENTS

| | | |
|---|---|---|
| 826584 | 11/1969 | (CA) . |
| 1145584 | 5/1983 | (CA) . |

(List continued on next page.)

OTHER PUBLICATIONS

Reward Wall Systems; printed from www.rwsinc.com.
Thermalite Insulated Concrete Forming System; printed from www.thermalite.com.

(List continued on next page.)

*Primary Examiner*—Peter M. Cuomo
*Assistant Examiner*—Rodney B. White
(74) *Attorney, Agent, or Firm*—Merchant & Gould

(57) ABSTRACT

A connector link component for use in an insulated concrete form system having first and second side panels and at least two connectors, each side panel having an exterior surface, an opposed interior surface, and at least one attachment coupling, the panels arranged in spaced parallel relationship with their interior surfaces and attachment couplings facing each other so that a cavity is formed therebetween, each connector having a first end and a distal second end, a first length extending therebetween, and a pair of opposed connector couplings, one connector coupling formed in the first end and the other connector coupling formed in the second end, so that the each connector coupling of each connector is adapted to engage one attachment coupling of the side panel, the connector link having a proximal end, having a first link coupling for engagement to the connector coupling of one connector of the concrete form system, a distal end, having a second link coupling for engagement to the connector coupling of one other connector of the concrete form system, and a substantially rigid body portion extending between the proximal end and the distal end of the connector link so that the connector link may be operatively engaged to the opposed connectors to structurally connect one attachment coupling on one side panel to one other attachment coupling on the other side panel.

15 Claims, 17 Drawing Sheets

U.S. PATENT DOCUMENTS

| | | | | |
|---|---|---|---|---|
| 3,847,521 | | 11/1974 | Stickler, Jr. . | |
| 3,902,296 | | 9/1975 | Thomas | 52/747 |
| 3,943,676 | | 3/1976 | Ickes | 52/309 |
| 3,985,329 | | 10/1976 | Liedgens | 249/40 |
| 4,177,617 | | 12/1979 | DeLuca et al. | 52/562 |
| 4,223,501 | | 9/1980 | DeLozier | 52/309 |
| 4,655,014 | | 4/1987 | Krecke | 52/105 |
| 4,698,947 | | 10/1987 | McKay | 52/309 |
| 4,706,429 | | 11/1987 | Young | 52/309 |
| 4,730,422 | | 3/1988 | Young | 52/105 |
| 4,742,659 | | 5/1988 | Meilleur | 52/309 |
| 4,765,109 | | 8/1988 | Boeshart | 52/426 |
| 4,866,891 | | 9/1989 | Young | 52/105 |
| 4,879,855 | | 11/1989 | Berrenberg | 52/309 |
| 4,884,382 | | 12/1989 | Horobin | 52/426 |
| 4,888,931 | | 12/1989 | Meilleur | 52/426 |
| 4,889,310 | | 12/1989 | Boeshart | 240/41 |
| 4,894,969 | | 1/1990 | Horobin | 52/309 |
| 4,901,494 | | 2/1990 | Miller et al. | 52/309 |
| 4,936,540 | | 6/1990 | Boeshart | 249/216 |
| 4,938,449 | | 7/1990 | Boeshart | 249/216 |
| 4,949,515 | | 8/1990 | Krecke | 52/105 |
| 4,967,528 | | 11/1990 | Doran | 52/309 |
| 5,003,746 | | 4/1991 | Wilston | 52/589 |
| 5,107,648 | | 4/1992 | Roby | 52/309 |
| 5,140,794 | | 8/1992 | Miller | 52/309 |
| 5,154,032 | | 10/1992 | Ritter | 52/593 |
| 5,371,990 | | 12/1994 | Salah Uddin | 52/379 |
| 5,390,459 | | 2/1995 | Mensen | 52/426 |
| 5,428,933 | * | 7/1995 | Phillippe | 52/426 X |
| 5,459,971 | | 10/1995 | Sparkman | 52/426 |
| 5,566,518 | | 10/1996 | Martin et al. | 52/426 |
| 5,570,552 | | 11/1996 | Nehring | 52/426 |
| 5,611,183 | | 3/1997 | Kim | 52/426 |
| 5,625,989 | | 5/1997 | Brubaker et al. | 52/309 |
| 5,657,600 | | 8/1997 | Mensen | 52/426 |
| 5,701,710 | | 12/1997 | Tremelling | 52/426 |
| 5,704,180 | | 1/1998 | Boeck | 52/426 |
| 5,735,093 | | 4/1998 | Grutsch | 52/309 |
| 5,809,727 | | 9/1998 | Mensen | 52/426 |
| 5,809,728 | | 9/1998 | Tremelling | 52/426 |
| 5,845,449 | * | 12/1998 | Vaughn et al. | 52/426 X |
| 5,852,907 | * | 12/1998 | Tobin et al. | 52/426 X |
| 5,857,300 | * | 1/1999 | Gates | 52/426 |
| 5,890,337 | * | 4/1999 | Boeshart | 52/426 |
| 5,896,714 | | 4/1999 | Cymbala et al. | 52/426 |
| 5,992,114 | * | 11/1999 | Zelinsky et al. | 52/426 |
| 6,079,176 | | 6/2000 | Westra et al. | 52/404 |

FOREIGN PATENT DOCUMENTS

| | | |
|---|---|---|
| 1154278 | 9/1983 | (CA) . |
| 1182304 | 2/1985 | (CA) . |
| 1194706 | 10/1985 | (CA) . |
| 1209364 | 8/1986 | (CA) . |
| 1233042 | 2/1988 | (CA) . |
| 1234701 | 4/1988 | (CA) . |
| 1244668 | 11/1989 | (CA) . |
| 1303377 | 6/1992 | (CA) . |
| 1304952 | 7/1992 | (CA) . |
| 2118343 | 10/1994 | (CA) . |
| 2219414 | 10/1997 | (CA) . |
| 28 04 402 | 8/1978 | (DE) . |
| 1384868 | 12/1965 | (FR) . |

OTHER PUBLICATIONS

Quad–Lock Insulated Forms; printed from www.oikos.com.
The Greenblock System; printed from www.greenblock-.com.
Greenblock Building System; printed from www.smart-block.com.
The Polysteel Forms.
Hurricane Homes & Construction, Inc.—Technical Information on Exterior Wall Element—printed from www.hurricanehomes.com.
Consulwal Concrete Forming, Concrete Block Construction from Consuwal, Queensville, Ontario.
KT Semi–Precast Panels (Japanese).
09/427,374 dated Oct. 25, 1999 –Co–pending Application of same applicant, the specification in the 09/427374 application is the same as the co–pending 09/426,572 application.
09/427,373 dated Oct. 25, 1999 –Co–pending Application of the same applicant, the specification in the 04/427,373 application is the same as co–pending 09/426,572 application.
09/654,024 dated Mar. 29, 2001 –Co–pending Application of same applicant.
09/654,024 dated Sep.1, 2000 –Co–pending Application to same applicant, the specification in the 09/654,024 is the same as U.S. Pat. No. 6,170,220.

* cited by examiner

CONCRETE FORM SYSTEM CONNECTOR LINK AND METHOD

This application claims priority to Provisional Application Ser. No. 60/105,598, which was filed on Oct. 26, 1998, which is fully incorporated herein.

BACKGROUND OF THE INVENTION

1. Field of the Invention

The present invention relates generally to a method and system for use in forming concrete walls, blocks and other components. The invention relates more particularly to components of a concrete form system, and methods of using the same, including: i) side panels having an improved web member structure embedded therein; ii) a connector link for joining two or more connectors spanning between two side panels of the concrete form system to create a form cavity of extended incremental width dimension; iii) a ledge assembly for providing a bearing surface, such as for supporting a brick fascia, a flooring system, or other components; iv) a corner web member for incorporation into corner side panels of the concrete form system for attachment of wall cladding; and v) a termite infestation identification surface incorporated into a side panel of the concrete from system.

2. Description of Related Art

Concrete walls in building construction traditionally have been produced by first setting up two spaced apart form panels and pouring concrete into the space between the form panels. After the concrete hardens, the builder then removes the forms, leaving the cured concrete wall. This technique has been found to present a number of drawbacks. For example, formation of concrete walls using the traditional technique is inefficient because of the time required to erect the forms, wait until the concrete cures, and take down the forms. The traditional forming and fabricating technique, therefore, is an expensive, labor-intensive process. Moreover, the provision of a ledge or other bearing surface using traditional forming techniques greatly increases the complexity and expense of a project.

Improved techniques have been developed for forming modular concrete walls, using a foam insulating material for the form panels. The modular form panels are set up, typically generally parallel to each other, with connecting components holding the two form panels in place relative to each other. Concrete is then poured into the space between the foam form panels. Unlike the traditional forming technique, however, the foam form panels remain in place after the concrete has cured. That is, the form panels become a permanent part of the building after the concrete cures. The concrete walls made using this technique can be stacked on top of each other many stories high to form all of a building's walls. In addition to the efficiency gained by eliminating the need for removal of the form panels from the structure, the foam material of the form panels provides the finished wall with improved thermal insulation and acoustical impedance characteristics, as compared to bare concrete walls.

A number of variations of modular insulating concrete forms and methods for their use have been developed. Concrete form systems utilizing opposed side panel forms joined by connectors to define a chamber therebetween are known. For example, U.S. Pat. Nos. 4,698,947; 4,730,422 and 4,884,382, all incorporated herein by reference, disclose concrete form systems incorporating connectors for holding the side panels in spaced relation; and U.S. Pat. No. Des. 378,049, also incorporated herein by reference, discloses a connector for such systems. Although the exemplified prior art proposed variations to achieve improvements with concrete form systems, drawbacks still exist for each design. The connecting components used in the prior art to hold the walls are typically constructed of plastic foam, high density plastic, or a metal bridge, which acts as a non-structural support, i.e., once the concrete cures, the connecting components serve no function.

A further exemplified embodiment of a prior art connecting component for a concrete form system is disclosed in U.S. Pat. No. 5,390,459, which issued to Mensen, on Feb. 21, 1995 and which is incorporated herein by reference. This patent discloses "bridging members" that comprise end plates connected by a plurality of web members. The bridging members also use reinforcing ribs, reinforcing webs, reinforcing members extending from the upper edge of the web member to the top side of the end plates, and reinforcing members extending from the lower edge of the web member to the bottom side of the end plates. As one skilled in the art will appreciate, this support system is expensive to construct, which, in turn, increases the cost of the formed wall. It has been found that such concrete form systems may be improved upon through the provision of a modified web member in place of the above described web member 16.

One further disadvantage common to the prior art concrete form systems is the limited ability to vary the spacing between side panels of the forms, and thereby, the thickness of the finished concrete wall. Typically, connectors or bridging members are provided in several standard lengths, often in two-inch increments (i.e., 2", 4", 6" and 8"), to produce standard wall thicknesses. It has been found desirable however, for certain applications, to produce walls of greater or different thickness than is permitted using standard length connectors. For example, desired wall thicknesses of up to and possibly exceeding 24" may be encountered. Typically, however, owing in part to the dimensions of associated commercially available building materials, walls are formed with thicknesses of even two-inch increments. The provision of separate connectors manufactured in lengths adapted to produce walls of every potential incremental thickness (e.g., 4", 6", 8", . . . up to 24" or more) would be prohibitively expensive. Known adjustable length connectors are expensive to produce and complicated to install, thus increasing fabrication costs and potential for incorrect adjustment and installation. Thus, it has been found that a need exists for a concrete form system and method of concrete fabrication enabling the production of walls of various thicknesses utilizing standard components.

For certain applications during building of concrete structures, it is also often desirable to provide a bearing surface, such as a ledge or shelf, on a concrete wall or other structure. For example, a brick fascia may be provided on the exterior surface of a concrete wall, typically extending upwardly from grade, and/or bearing surfaces for floor joists, floor trusses, ceiling joists or other building components may be required on the interior surface of a wall. Known insulated concrete form systems have been found to present undesirable disadvantages in forming such bearing surfaces. For example, the brick shelf form described in U.S. Pat. No. 5,657,600 has been found less than fully satisfactory due to the presence of thick foam partitions between cut-away areas of the form panels. These foam partitions present substantial interruptions in the concrete bearing surface, potentially weakening the support provided thereby. An additional disadvantage to the brick shelf form described in U.S. Pat. No. 5,657,600 results from the inability to vary the thickness of the wall formed due to the fixed size of the bridging members embedded into the form panels. Thus, it has been found that a need exists for an improved concrete form system and method of concrete fabrication enabling the production of walls and other components including bearing surfaces such a brick ledges and/or floor joists.

In the construction of a building, it is also often desirable, and in some cases required by local building ordinance, to provide a termite infestation detection structure on a concrete wall or other structure having insulated side panels. Unfortunately, the various other concrete form systems utilizing opposed side panel forms enclosing a core of concrete, exemplified in U.S. Pat. Nos. 4,698,947; 4,730,422; and 4,884,382, may allow the undetected infiltration of termites via the insulated side panels into vulnerable structures, such as for example wood framed construction, mounted onto the concrete form system. Typical detection of termite infestation requires some form of visual detection of the presence of the unwanted insects. However, because the infiltration typically occurs between the concrete in the cavity and the interior surface of the side panel or within the material forming the side panel, any damaging infestation may not be detected until significant damage to the vulnerable structures has been completed. Thus, it has been found that a need exists for a method of concrete fabrication enabling the production of walls incorporating a termite detection surface for visual detection of possible termite infestation of the building.

It is to the provision of a concrete form system and method of concrete wall fabrication meeting these and other needs that the present invention is primarily directed.

SUMMARY OF THE INVENTION

Briefly described, the present invention comprises a concrete form system and a method of fabrication for the production of concrete walls, blocks, beams, ledges, foundations, floor and roof panels that overcomes the disadvantages of the prior art. The present invention further includes improved components for the concrete form system and concrete structures formed by such a system, components, and/or methods.

Applicant's U.S. Pat. No. 6,170,220, and U.S. Pat. No. 5,887,401, which are incorporated in their entirety herein by reference, disclose improved concrete form systems and methods. Referring to FIGS. 1 and 2, and as disclosed in the applicant's '220 patent and the '401 patent, an example concrete form system is shown that is capable of adaptation and use with the improvements and components of the present invention. Opposed longitudinally-extending side panels 10, 12 comprise the form panels, defining a cavity 14 therebetween, into which uncured concrete is poured to fabricate a concrete block, wall, panel or other component. Each side panel 10, 12 incorporates a number of web members 16, partially embedded within or otherwise attached to the side panel 10, 12, and having one or more attachment points 17 external of the side panel 10, 12. Since the web member is an integral part of the side panel, it "locks" the side panel to the concrete once the concrete is poured and cures within the cavity. Each web member preferably has an end plate disposed adjacent the exterior surface of the respective side panel. The end plates may be located slightly below the exterior surface of, or recessed within, the side panel, preferably at a distance of one-quarter (¼) of an inch from the exterior surface or may abut the exterior surface of the panels so that a portion of the end plate is exposed over the exterior surface. The end plates provide a mounting surface for the allow for secure attachment of, for example, exterior fascia such as siding.

Opposed pairs of attachment points 17 of the of web members 16 attached to each side panel 10, 12 are joined by connectors 18. The attachment points of each web member are also oriented substantially upright so that one attachment point is disposed above another attachment point. As best shown in FIG. 2, the plurality of attachment points of each web member are vertically disposed within the cavity in a substantially linear relationship. Each connector 18 includes first and second connector couplings that engage opposed attachment points 17 of the side panels 10, 12. One or more mounting apertures 24 can be provided on the connectors 18 for receiving re-bar.

In one aspect, the present invention provides a concrete form system having at least one longitudinally-extending side panel, and more preferably, a first longitudinally-extending side panel and a second longitudinally-extending side panel having opposed interior faces spaced apart to define a cavity therebetween. The side panels preferably comprise an insulating material, such as expanded polystyrene (EPS). Each side panel preferably includes at least one web member disposed and integrally formed at least partially within the side panel and extending from adjacent the exterior surface of the side panel through and out of the interior surface of the side panel. The portion of the web member extending from the interior surface of the side panel forms at least one upper attachment coupling, at least one lower attachment coupling, and a medial attachment coupling. The system preferably further comprises one or more connectors for detachable engagement with the attachment couplings of the web members.

In one preferred embodiment, the improved web member includes an end plate, a plurality of support struts extending from the end plate, and attachment couplings connected to each of the support struts, distal the end plate. In a further preferred embodiment, the web member has two upper attachment couplings, two lower attachment couplings, and a medial attachment coupling and five support struts, arranged in a generally linear array comprising a first group of two support struts and two upper attachment couplings, a second group of two support struts and two lower attachment couplings, and a medial strut and attachment coupling disposed between the first and second groups.

Still further, the web member may have a plurality of bridging members and end struts to add structural rigidity to the web member. The bridging members preferably extend between adjacent support struts and the ends of the bridging members and are preferably connected near the respective distal ends of adjacent support struts proximate the connected attachment coupling. Preferably, the web member may also have a first end strut and a second end strut, the first end strut extending from the end plate near the top edge of the end plate to near the distal end of the closet adjacent support strut and the second end strut extending from the end plate near the bottom end of the end plate to near the distal end of the closest adjacent support strut.

In use, the first and second side panels are first vertically disposed so that a portion of the interior surfaces of the side panels are spaced apart from each other to form a cavity. When the side panels are disposed in this manner, the attachment couplings of the web members which extend from, and are spaced apart from, the interior surface of each side panel are preferably arranged so that the attachment couplings of one web member opposes and is spaced apart a predetermined distance from the attachment couplings of the other web member in the other side panel. At least one connector is detachably attached to two opposing attachment couplings to connect the two erected side panels and the cavity is substantially filled with concrete for curing therein.

Another aspect of the present invention provides an insulated concrete slab structure. In preferred form, the insulated concrete slab structure includes at least one side panel, at least one web member, and a concrete slab having a surface in contact with at least one side panel. In this aspect, it is preferred that the improved web member be disposed and integrally formed at least partially within each side panel and have at least one upper attachment point, at least one lower attachment point, and a medial attachment point that is disposed within said concrete slab.

The concrete form system may also include a ledge assembly. The ledge assembly preferably includes a ledge panel, at least one ledge web member, and a plurality of ledge attachment couplings. The ledge panel preferably has a ledge interior surface, an opposing ledge exterior surface, a lower edge, an upper edge and a generally planar panel body extending therebetween. Each ledge web member has an embedded portion that is partially disposed and integrally formed within the panel body, and an exposed portion extending outward of the ledge interior surface of the panel body. The ledge attachment couplings are preferably arranged in a generally linear array along the exposed portion of ledge web member, the generally linear array of attachment couplings preferably forming an acute angle with the generally planar panel body. The lower edge of the ledge panel can optionally include a first mounting coupling for engaging a lower side panel component of the concrete form system, and the ledge web member can optionally include a second mounting coupling for engaging an upper side panel component of the concrete form system.

In one preferred embodiment of the ledge assembly, a portion of the ledge interior surface of the ledge panel faces, and is spaced apart from, a portion of the interior surface of a side panel to form a ledge cavity therebetween. The attachment couplings of the web members of the side panel and the ledge attachment couplings of the ledge web members are preferably generally disposed in opposition within the ledge cavity. Further, it is preferred that the attachment couplings of the side panel are generally aligned in a first plane adjacent to, and preferably parallel to, the interior surface of the side panel and the ledge attachment couplings of the ledge web members are preferably generally disposed parallel to the first plane so that the attachment couplings and the opposed ledge attachment couplings are spaced apart a predetermined distance. The ledge panel preferably extends at an acute angle from the first plane in the direction of the ledge exterior surface of the ledge panel. The concrete form system preferably further includes a plurality of connectors engaged between the ledge attachment couplings of the ledge web members and the attachment couplings of the web members.

The concrete form system can optionally further include a second ledge panel assembly having a second ledge panel and a plurality of second ledge attachment couplings. In this embodiment, the second ledge attachment couplings of the second ledge panel assembly are generally aligned along a second plane adjacent the interior surface of the second side panel to which the second ledge panel assembly is attached, with the second ledge panel extending at an acute angle from the second plane in the direction of the exterior surface of the second side panel. It is preferred that the second ledge attachment coupling be spaced apart from and in opposition to one or more attachment coupling of an opposing side wall or one or more ledge attachment couplings of an opposing ledge panel. The connectors can be detachedly engaged to any two opposing attachment couplings. Thus, additional bearing surfaces can be provided in like manner on either or both surfaces of the wall.

In use, the present invention provides a method of fabricating a concrete wall or other component having one or more weight bearing ledge surfaces. In preferred form, the method of providing a weight bearing ledge surface comprises the step of erecting a first form panel having an interior surface, an exterior surface, and a plurality of attachment points generally aligned along a first plane adjacent the interior surface, and erecting a second form panel having an interior surface, an exterior surface, and a plurality of attachment points generally aligned along a second plane adjacent the interior surface. The interior surfaces of the first and second form panels confront one another and are separated a distance to define a cavity therebetween. The method further comprises installing a ledge panel assembly having a ledge panel and a plurality of attachment couplings onto the top of the first side panel. The ledge attachment couplings of the ledge panel assembly are preferably installed to be generally aligned with the attachment couplings along the first plane, and the ledge panel extends at an acute angle from the first plane in the direction of the exterior surface of the first side panel and from the interior surface of the second side panel to define a ledge cavity therebetween the ledge panel and the second side panel. The method further comprises engaging a plurality of connectors between attachment points aligned along the first plane and attachment points aligned along the second plane. The method further comprises substantially filling the cavity between the first and second side panels and the ledge cavity with concrete.

The concrete form system and method of the present invention may also provide a corner web member. Here, the concrete form system has a first corner panel having two longitudinally-extending side panels connected to form a substantially vertical corner panel edge in the exterior surface of the corner panel. The corner panel may be connected to other longitudinally-extending side panels of the structure described above. The corner web member includes a corner flange member, a bridging member, and a plurality of support struts. The corner flange member has a longitudinally-extending first leg and a longitudinally-extending second leg connected to form a corner flange edge in the upper surface of the corner flange member. The proximal end of each support strut connected to the lower surface of the corner flange member and the distal end of each support strut connected to the top edge of the bridging member to structurally stabilize the corner web member.

The corner web member is partially disposed and integrally formed within the first corner panel so that a portion of the corner web member extends through the interior surface of the first corner panel. The corner flange member and the proximal end of each support strut is embedded within the first corner panel. It is preferred that the corner flange member be adapted to frictionally hold a metal fastener therein and be disposed adjacent the exterior surface of the corner panel. It is further preferred to dispose the corner flange member of the corner web member within the first corner panel so that the corner flange edge of the corner flange member is substantially parallel to the corner panel edge of the corner panel. The corner flange member is preferably shaped so that the upper surface of the corner flange member is substantially parallel to the exterior surface of the corner panel, i.e., if the corner panel is "L" shaped, the corner flange member is also preferably "L" shaped.

The corner web member may also have a support flange member having an upper surface which is connected to the bottom edge of the bridging member. The support flange member is spaced apart from, and preferably parallel to, the interior surface of the corner panel. The support flange member preferably has a shape that is complementary to the shape of the corner flange member, i.e., if the corner flange member is "L" shaped, the support flange member is also preferably "L" shaped.

The present invention may also include a method of fabricating a concrete structure having a corner web member. In this method of using the concrete forming system, a first and a second corner panel are erected so that a portion of the interior surface of the first corner panel faces, and is spaced apart from, a portion of the interior surface of the second corner panel so that a cavity is formed. The first corner panel has a corner web member partially disposed within the first corner panel so that a portion of the corner web member extends through the interior surface of the first corner panel into the cavity between the first and second corner panels. The first and second corner panels preferably each have a plurality of attachment couplings spaced apart from the interior surfaces of the first and second corner panels. Next, a connector is attached to at least one opposing pair of attachment couplings extending from the respective first and second side panels. Finally, the cavity formed between the first and second corner panels is substantially filed with concrete and allowed to cure.

The concrete form system and method of the present invention may also allow the combination of standard connectors and/or connector links in various manners to create a concrete structure of any desired thickness. In this embodiment, the concrete forming system preferably includes first and second longitudinally-extending side panels having opposed interior faces defining a cavity therebetween. Each of the side panels has at least one attachment coupling. The concrete form system preferably further includes at least two connectors disposed within the cavity between the side panels and a connector link disposed within the cavity between two opposing connectors. Each connector has a first end with a first connector coupling, an opposing second end having a second connector coupling, and a first length extending therebetween. Preferably, the first and second connector couplings have the same shape. The first connector coupling is adapted to engage one attachment coupling of the side panel.

The concrete form system preferably further includes a connector link having a proximal end having a first link coupling and a distal end having a second link coupling. The first link coupling and the second link coupling are adapted to engage the second connector coupling of a connector of the concrete form system. The connector link preferably includes a substantially rigid body portion extending between the proximal and distal ends of the connector link. In a preferred embodiment, the first and second link couplings have the same shape as the attachment couplings of the side panels of the concrete form system so that connector components of the concrete form system can engage the attachment couplings or the connector link couplings. Thus, the connector link can be directly coupled to any two opposing connector and any desired dimensional increments may be achieved through the coupling of one or more intermediate links and/or connectors.

In use, the method of constructing a concrete structure for this embodiment of the present invention preferably comprises the steps of erecting first and second form panels so that opposed interior faces of the first and second form panels define a cavity therebetween, engaging a first connector with the first form panel, engaging a second connector with the second form panel, attaching a connector link between the first connector and the second connector, and substantially filling the cavity with concrete to be cured therein.

Further, the method of the present invention for constructing a concrete structure having a termite infestation detection surface comprises the steps of: providing two longitudinally-extending side panels, detachably securing a longitudinally-extending support panel to the exterior surface of one of the side panels so that the interior surface of the support panel overlies the exterior surface of the side panel, removing a longitudinally-extending strip of the side panel having the secured support panel so that a longitudinally-extending portion of the interior surface of said side panel is exposed, wherein the strip has a width less than the width of the support panel, erecting the side panels so that a portion of the interior surface of the side panel having the secured support panel and a portion of the exposed interior surface of the secured support panel faces a portion of, and are laterally spaced therefrom, the interior surface of the other side panel to form a cavity therebetween, attaching a connector to the attachment couplings of two opposed web members which are within the opposed side panels, pouring concrete into the cavity formed between the side panels to be cured therein, and subsequently removing the support panel from the exterior surface of the side panel after the concrete has cured to expose the surface of the cured concrete. The exposed surface preferably extends the longitudinal length of the side panel and forms the termite infestation detection surface. Termites are forced to traverse the exposed termite infestation detection surface to reach the portion of the concrete structure above the detection surface and may be visually detected thereon the detection surface.

These and other features and advantages of preferred component and methods of the present invention will become more readily apparent from the following detailed description of the invention taken in conjunction with the accompanying drawings.

DETAILED DESCRIPTION OF THE INVENTION

Figure 2:
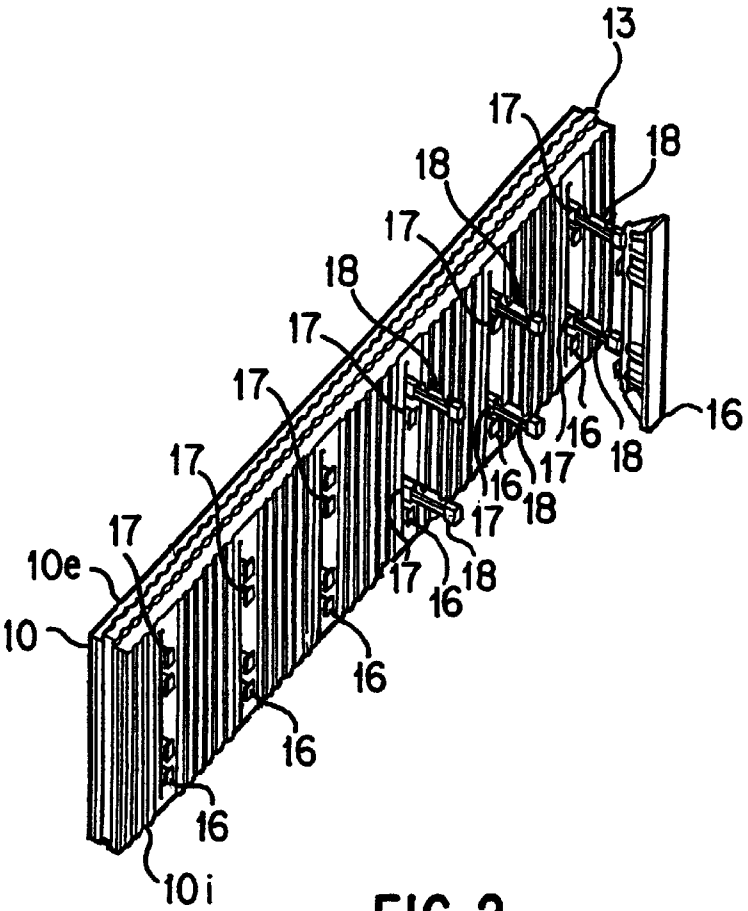
FIG. 2 is a front perspective view of one side panel of the concrete form system shown FIG. 1, in which the web members show four attachment couplings extending through the interior surface of the side panel, two web members show two connectors attached to attachment couplings, and one web member shows two connectors and another web member attached thereto.

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiments are now described with reference to the figures, in which like numbers indicate like parts throughout the figures.

As described above, FIGS. 1–3 show an example concrete form system having first and second side panels 10, 12, each including one or more web members 16 with attachment couplings 17 extending outward of the side panels 10, 12. One or more connectors 18 having first and second coupling elements at opposite ends thereof engage the attachment couplings 17 of web members 16, or otherwise retain the side panels 10, 12 in a spaced apart configuration, to define a cavity 14 between the opposed interior faces of the panels 10, 12. Concrete is poured into the cavity 14 to form a concrete wall, block, beam, foundation, floor or roof panel, or other concrete component, of a shape and dimension defined by the cavity 14.

Figure 1:
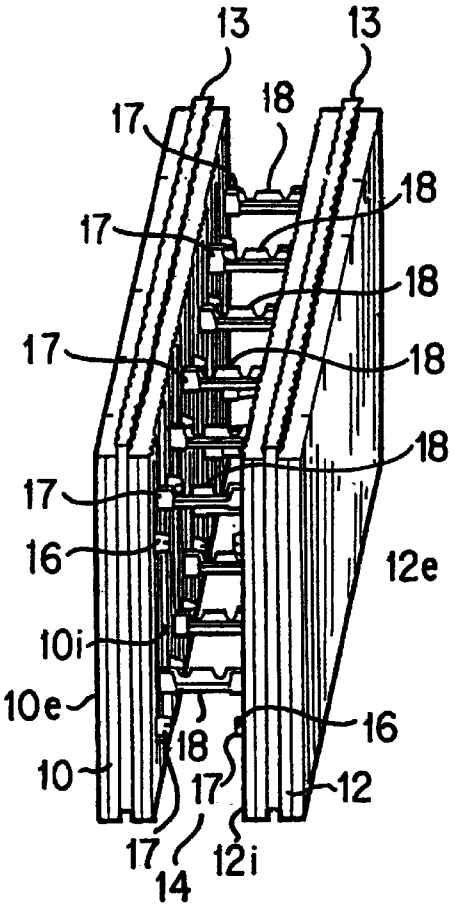
FIG. 1 is a perspective view of a concrete form system.

The depicted embodiment of the present invention, shown in FIGS. 1 and 2, comprises at least two opposed longitudinally-extending side panels 10, 12, between which concrete is poured to bond with the form panels. A second embodiment of the present invention involves using a single side panel 10 that bonds with the concrete, for example to form a concrete slab, instead of using opposed side panels 10, 12 on both sides of the concrete. Each side panel 10, 12 has, a top end, a bottom end, a first end, a second end, an exterior surface, 10*e*, 12*e*, and an interior surface 10*i*, 12*i*. An example side panel 10, 12 can be provided having a thickness (separation between the interior surface and exterior surface) of approximately two and a half (2½) inches, a height (separation between the bottom end and the top end) of sixteen (16) inches, and a length (separation between the first end and second end) of forty-eight (48) inches. In an alternative example, the side panels 10, 12 may have a thickness of approximately two (2) inches, a height of approximately twenty-four (24) inches, and a length of approximately forty-eight (48) inches. As one skilled in the art will appreciate, providing a side panel 10, 12 of extended height allows for an increased speed of construction as fewer layers of the side panels must be constructed to provide a wall of a desired height. Also, having a side panel thickness of approximately two inches allows the overall wall thickness, in a typical wall construction using a four inch connector, to match the existing wall dimensional thickness of conventional concrete block/masonry or wood frame construction. By matching the construction industries conventional standard dimensions, and therefore not changing usable interior space from conventional construction standard, an insulating concrete form ("ICF") system, such as the present invention, becomes highly advantageous because of the superior strength of its monolithic reinforced concrete, sound proofing, and superior fire rating when compared to conventional construction methods.

The dimensions can be further altered, if desired, for different building projects, such as increasing the thickness of the form panels 10, 12 for more insulation. Half sections of the form panels 10, 12 can be used for footings. It will also be understood that the side panels 10, 12 may take any of a number of configurations, including for example: flat panels; curved panels; corner panels of various angular displacement; panels comprising indentations, projections or other surface features; door, window or other opening forms; and/or other configurations.

The interior surface 10*i* of one side panel 10 preferably faces the interior surface 12*i* of another side panel 12 in the first embodiment and the opposed interior surfaces 10*i*, 12*i* are laterally spaced apart from each other a desired separation distance so that a cavity 14 of predetermined width is formed therebetween. Concrete—in its fluid state—is poured into the cavity 14 and allowed to cure (i.e., harden) therein to form the wall. The volume of concrete received within the cavity 14 is defined by the separation distance between the interior surfaces 10*i*, 12*i*, the height of the side panels 10, 12, and the length of the side panels 10, 12.

The side panels 10, 12 are preferably constructed of polystyrene, specifically expanded polystyrene ("EPS"), which provides thermal insulation and sufficient strength to hold the poured concrete until it substantially cures. The formed concrete wall using polystyrene with the poured concrete has a high insulating value so that no additional insulation is usually required. In addition, the formed walls have a high impedance to sound transmission.

As described in greater detail in U.S. Pat. Ser. No. 090/008,437, U.S. Pat. No. 6,170,220 incorporated in its entirety herein by reference, the interior surfaces 10*i*, 12*i* of the side panels 10, 12 preferably includes a series of indentations therein that enhance the bond between the side panels 10, 12 and concrete. To improve further the bond between the side panels 10, 12 and the concrete poured in the cavity 14, a portion of each of the web members 16 formed in the side panels 10, 12 extends through the interior surface of the side panels 10, 12 into the cavity 14. Since at least a portion of each web member 16 is integrally formed within its respective side panel 10, 12, and the portion of the web member 16 that extends into the cavity 14 is also cured within the concrete, the web member 16 acts to strengthen the connection between the side panel 10, 12 and the concrete. That is, since the web member 16 is an integral part of the side panel 10, 12, it "locks" the side panel 10, 12 to the concrete once the concrete is poured and cures within the cavity 14 around exposed portions of the web member 16.

Each side panel 10, 12 has at least one web member 16 formed into it. Preferably, adjacent web members 16 formed within a side panel 10, 12 are separated a predetermined longitudinal distance, which is typically eight (8) inches. Based on the preferred length of the side panel 10, 12 of forty-eight inches, approximately six web members 16 may be disposed within each side panel 10, 12.

The portions of each web member 16 that extend through the interior surface of the side panels 10, 12 form attachment couplings 17. The attachment couplings 17 are disposed within the cavity 14 and are spaced apart from the interior surface of the side panels 10, 12. One or more connectors 18 detachably engage attachment couplings 17 on opposed web members 16, which position the interior surfaces 10*i*, 12*i* of the side panels 10, 12 at a desired, predetermined, separation distance. The connectors 18, when operatively connected to the attachment couplings 17 of the respective side panels 10, 12, provide support to the side panels 10, 12 when the concrete is poured into the cavity 14. The ends of the connector 18 are of a shape to complementarily and removably engage the attachment coupling 17 of two respective web members 16 within opposed panels 10, 12. The attachment couplings 17 may take any of a number of alternate forms, including for example: slots, channels, grooves, projections or recesses formed in the form panels 10, 12; hooks or eyelets projecting from or formed in the form panels 10, 12; twist, compression or snap couplings; or other coupling means for engaging cooperating coupling portions of the connectors 18. Preferably, however, the attachment coupling 17 is substantially rectangular and flat and each end of the connector 18 has a channel and slot forming a connector coupling into which the rectangular shaped attachment coupling 17 is slidably received.

Figure 3:
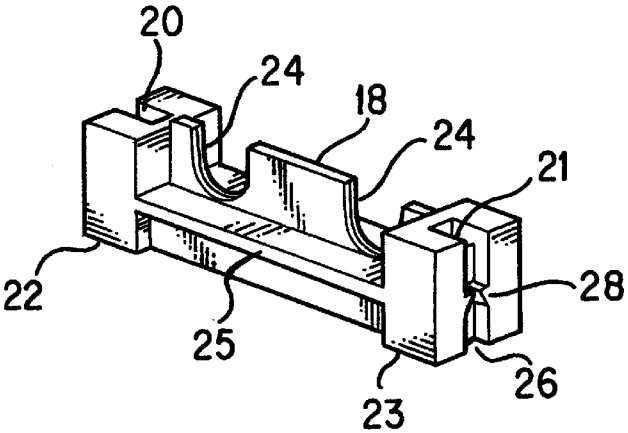
FIG. 3 is a perspective view of a connector component of the concrete form system shown in FIG. 1.
Figure 7:
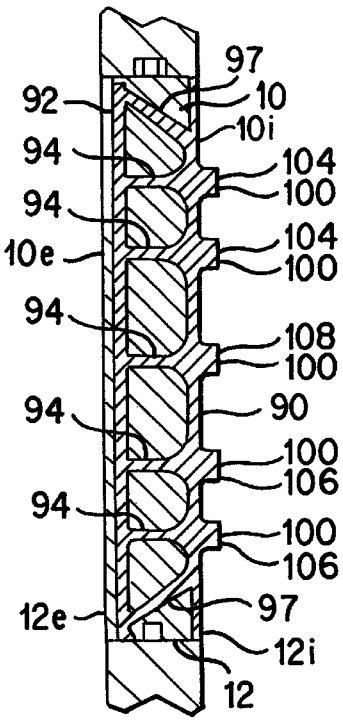
FIG. 7 is a cross-sectional view of the side panel shown in FIG. 6, in which a portion of the side panel is cut away to show the body portion of the web member partially disposed and integrally formed within the side panel.

As best shown in FIG. 3, the connector 18 preferably also has at least one aperture 24 of a size to complementarily receive a re-bar (not shown) therein. The re-bar provides reinforcing strength to the formed wall. Alternatively, and as described in greater detail below, a first connector 18 can be engaged with an attachment couplings 17 on first panel 10, a second connector 18 engaged with an attachment point on second panel 12, and a connector link engaged between the first and second connectors 18, thereby enabling the formation of concrete components of selected incremental thicknesses.

Referring now to FIGS. 4–7, the present invention provides an improved web member 90 for use in place of the web member 16 described above shown above in FIGS. 1–3. The web members 90 are provided within the side panels 10, 12 in substantially the same manner and arrangement as the web members 16, and serve to engage the connectors 18 in substantially like manner as well.

The improved web member 90 preferably comprises an end plate 92, a plurality of attachment couplings 100, and a plurality of support struts 94 extending from the end plate 92 the attachment couplings 100. The web member 90 is partially disposed and integrally formed within each side panel 10, 12 so that a portion of each of the web members 90 extends through the respective interior surface 10*i*, 12*i* of the side panels 10, 12.

The end plate 92 has a top surface 91 and an opposing bottom surface 93 and preferably has a substantially planar, rectangular shape. When a portion of the web member 90 is embedded within a side panel 10, 12, the end plate 92 is preferably substantially completely disposed within a portion of the side panel 10, 12. That is, the end plate 92 is located slightly below the exterior surface of, or recessed within, the side panel 10, 12, preferably at a distance of approximately one-quarter (¼) of an inch from the exterior surface. This position allows for easily smoothing the surface of the side panels 10, 12 without cutting the end plate 92 should the concrete, when poured, create a slight bulge in the exterior surface of the side panels 10, 12. Recessing the end plate 92 also provides the additional benefit of providing a uniform exterior surface, which allows external surfacing, such as stucco for example, to be readily applied. Alternatively, the end plate 92 can abut the exterior surface of the side panels 10, 12. It is also preferred in the first embodiment that each end plate 92 is oriented substantially upright and disposed substantially parallel to the exterior surface of the side panels 10, 12. The end plate 92 is preferably adapted to receive and frictionally hold a metal fastener, such as a nail or screw, therein, thus providing "strapping" for a wall system that allows attachment of gypsum board (not shown), interior or exterior wall cladding (not shown), or other interior or exterior siding or wall treatment (not shown). Thus, the web members 90 function to align the side panels 10, 12, hold the side panels 10, 12 in place during a concrete pour, structurally support the side panels 10, 12 while the concrete cures, enhance the bond between the panels 10, 12 and the cured concrete, and provide strapping to connect siding and the like to the formed concrete wall structure.

The plurality of support struts 94 of the web member 90 preferably extend generally perpendicularly from the end plate 92. Each support strut 94 has a proximal end 95, a distal end 96, and a first longitudinal-length therebetween. The proximal end 95 of each support strut 94 is connected to the top surface 91 of the end plate 92 and the distal end 96 of each support strut 94 is connected to one attachment coupling 100 or other panel coupling. The proximal end 95 of each support strut 94 is integrally formed within the side panel 10, 20 to be embedded therein. The generally perpendicular arrangement of the struts 94 with respect to the end plate 92, and the co-axial alignment of one of the struts 94 with each attachment point 100, provides increased strength and resistance to forces encountered as concrete is poured into the cavity 14.

End struts 97 and a plurality of bridging members 110 can also be provided in the improved web member 90 for added strength. The end struts 97 preferably comprise a first end strut 98 and a second end strut 99. The first end strut 98 preferably extends from the top surface 91 of the end plate 92 near the top edge of the end plate 92 to near the distal end 96 of the closest adjacent support strut 94. Similarly, the second end strut 99 preferably extends from the top surface 91 of the end plate 92 near the bottom edge of the end plate 92 to near the distal end 96 of the closest adjacent support strut 94.

Each bridging member 110 has a first end 112 and a second end 114 and extends from one support strut 94 to one adjacent support strut 94. A portion of the bridging member 110 may be partially disposed and integrally formed within the side panel 10, 12 to enhance the structural support provided by the web member 90. That is, the bridging members 110 are located slightly below the interior surface 10*i*, 12*i*, of, or recessed within, the side panel 10, 12, or may abut the interior surface 10*i*, 12*i* of the side panels 10, 12 so that a portion of the bridging member 110 is exposed, and/or extends above, the interior surface 10*i*, 12*i* of the side panels 10, 12. Preferably, the first end 112 of one bridging member 110 is connected near the distal end 96 of one support strut 94 and the second end 114 of the bridging member 110 is connected near the distal end 96 of one other adjacent support strut 94. The bridging member 110 preferably extends generally perpendicular to the respective support struts 94 to which it is connected. As one skilled in the art will appreciate, the addition of the bridging members 110 significantly enhances the structural rigidity of the web member 90. This desired structural rigidity is further enhanced by the addition of the first and second end struts 98, 99.

Figure 5:
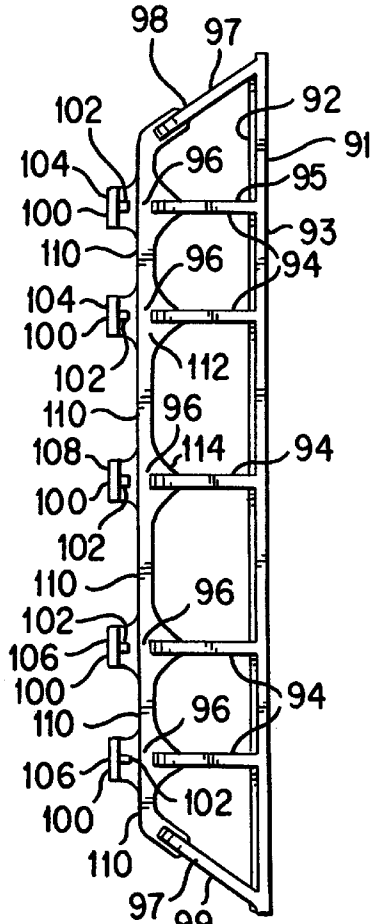
FIG. 5 is a side view of the improved web member shown in FIG. 4.

The modified web member 90 is preferably formed as an integral component, preferably constructed of plastic, and more preferably a high density plastic such as high-density polyethylene, although polypropylene or other suitable polymers may be used. Factors used in choosing the material include the desired strength of the web member 90 and the compatibility of the material of web member 90 with the material used to fabricate side panels 10, 12. As best shown in FIG. 5, the points of connection between the end plate 92, the struts 94, the attachment couplings 100, the end struts 97, and the bridging members 110 of the web member 90 are preferably chamfered or radiused to eliminate any sharp comers or transitions, and thereby reduce or eliminate any resultant stress concentrations.

Each of the attachment couplings 100 preferably comprises a generally rectangular element adapted to be slidably or otherwise engaged within a corresponding channel or connector coupling 20 of the connector 18. Recesses 102 or other engagement means can be provided on or adjacent the attachment couplings 100 for engagement with cooperating retaining shoulders provided on the connectors 18, in order to provide more secure attachment. In preferred form, a recess 102 is provided in each face of each strut 94 proximate the attachment couplings 100 of the web member 90. As seen best with reference to FIGS. 4 and 5, it is preferred that the recesses 102 do not penetrate through the entire thickness of the strut 94 of the web member 90, as such complete penetration may weaken the connection of the attachment point 100 to its respective support strut 94 and may provide a point of mechanical failure.

Figure 4:
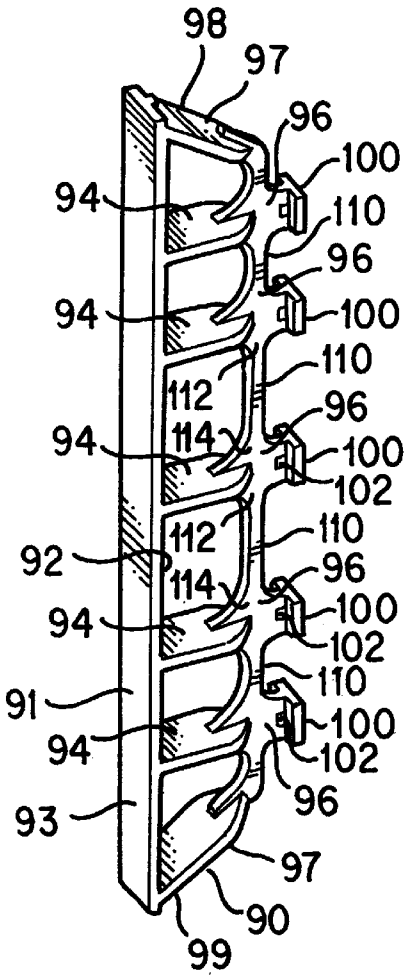
FIG. 4 is a perspective view of an improved web member according to a preferred embodiment of the present invention.
Figure 6:
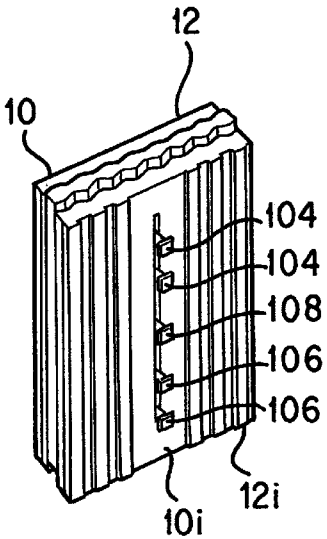
FIG. 6 is a perspective view of a side panel showing the improved web member shown in FIG. 4 partially disposed within the side panel.

As seen best with reference to FIGS. 4–6, the web member 90 of the present invention preferably comprises a substantially linear array of attachment couplings 100, comprising at least one upper attachment coupling 104, at least one lower attachment coupling 106, and a medial attachment coupling 108. The attachment couplings 100 are also oriented substantially upright so that one attachment coupling 100 is disposed above another attachment coupling 100. The attachment couplings 100 are preferably oriented substantially parallel to the interior surface 10*i*, 12*i* of the respective side panel 10, 12 and are thus spaced a predetermined distance from the interior surface 10*i*, 12*i*. In a more preferred embodiment, the web member 90 comprises five attachment couplings 100, each supported by a respective strut 94. In this embodiment the upper attachment coupling 104 comprises two attachment couplings 100 spaced a first distance apart from each other, the lower attachment coupling 106 comprises two attachment couplings 100 spaced the first distance apart, and the medial attachment coupling 108 comprises one attachment coupling 100. The closest attachment coupling 100 of the upper attachment coupling 104 is spaced apart from the singular medial attachment coupling 108 a second distance, which is greater than the first distance that separates the couplings 100 forming the upper and lower attachment couplings 104, 106. Similarly, the closest attachment coupling 100 of the lower attachment coupling 106 is spaced apart from the singular medial attachment coupling 108 by the second distance. Thus, the web member 90 advantageously comprises a first group of two struts 94 and attachment couplings 100 (the upper attachment couplings 104); a second group of two struts 94 and attachment couplings 100 (the lower attachment couplings 106); and a medial strut 94 and medial attachment coupling 108 between the first and second groups.

In an alternative embodiment of the web member 90, the web member 90 of the present invention comprises a substantially linear array of seven attachment couplings 100, each supported by a respective strut 94. In this embodiment, the upper attachment coupling 104 comprises three attachment couplings 100 spaced a longitudinal distance apart, the lower attachment coupling 106 comprises three attachment couplings 100 spaced the longitudinal distance apart, and the medial attachment coupling 108 comprises one attachment coupling 100. The closest attachment coupling 100 of the upper and lower attachment couplings 104, 106 is spaced apart from the singular medial attachment coupling 108 by a distance greater than, or approximately equal to, the longitudinal distance. Thus, the web member 90 advantageously comprises a first group of three struts 94 and attachment couplings 100 (the upper attachment couplings 104); a second group of two struts 94 and attachment couplings 100 (the lower attachment couplings 106; and a medial strut 94 and medial attachment coupling 108 between the first and second group, wherein the attachment couplings 100 of the web member 90 are preferably equally spaced apart from each other.

The provision of a medial attachment coupling 108 advantageously enables side panels 10, 12 to be cut horizontally to produce concrete components of selected heights, while still providing sufficient bracing and support for the side panels 10, 12 during the concrete pour. For example, the side panels 10, 12 can be cut horizontally, just above the medial attachment coupling 108 of the web members 90 within the panels 10, 12, and the panels 10, 12 will be adequately supported during the subsequent concrete pour by installing connectors 18 that engage the remaining attachment couplings 100. The spacing and use of the upper, lower, and medial attachment couplings 104, 106, 108 allow wide flexibility in the horizontal cutting of the side panels 10, 12 and web members 90 over a wide variety of heights to satisfy desired or requisite architectural requirements, without the necessity of providing extensive bracing to resist collapsing when concrete is poured into the cavity 14. The improved web member 90 of the present invention provides at least two attachment couplings 100 on the affected web member 90 after a requisite horizontal cut of the side panel 10, 12 and web members 90 which is sufficient to maintain the structural integrity of the formed wall.

Although FIGS. 1, 2 and 6, depict linear side panels 10, 12, the web member 90 of the present invention is also applicable to use with corner side panel sections of various angular offsets, as well as non-linear side panels for producing curved components.

As described above, the concrete system of the present invention comprises one or more side panels 10, 12, each comprising one or more web members 90 disposed therein. Attachment couplings 100 of the web members 90 are engaged with corresponding connector couplings 20 of connectors 18 for retaining the relative positions of the side panels 10, 20 during pouring of the concrete into the cavity 14. In this manner, an insulated concrete structure is provided. The resulting insulated concrete structure preferably includes at least one side panel 10, 12; at least one web member 90 disposed at least partially within each side panel 10, 12, having at least one upper attachment coupling 104, at least one lower attachment coupling 106, and a medial attachment coupling 108; and a concrete slab having a surface in contact with the interior surface 10*i*, 12*i* of at least one side panel 10, 12. As one skilled in the art will appreciate, the portions of the web member 90 that extend from the interior surface 10*i*, 12*i* of the panel 10, 12, which includes the attachment couplings 100, are cured within the concrete so that the web member 90 strengthens the connection between the side panel 10, 12 and the concrete. That is, since the exposed portions of the web member 90 extend into the cavity 14 and a portion of the web member 90 is an integral part of the side panel 10, 12, the side panel 10, 12 is "locked" to the concrete once the concrete is poured and cures within the cavity 14.

The present invention further enables a method of constructing a concrete structure. In preferred form, the method of the present invention comprises providing at least one side panel 10, 12 comprising a web member 90 having attachment points 100 for engaging connectors 18. The method of the present invention preferably further comprises erecting the side panels 10, 12 to define a cavity 14, and pouring concrete into the cavity 14 to form a concrete slab or other component.

Figure 8:
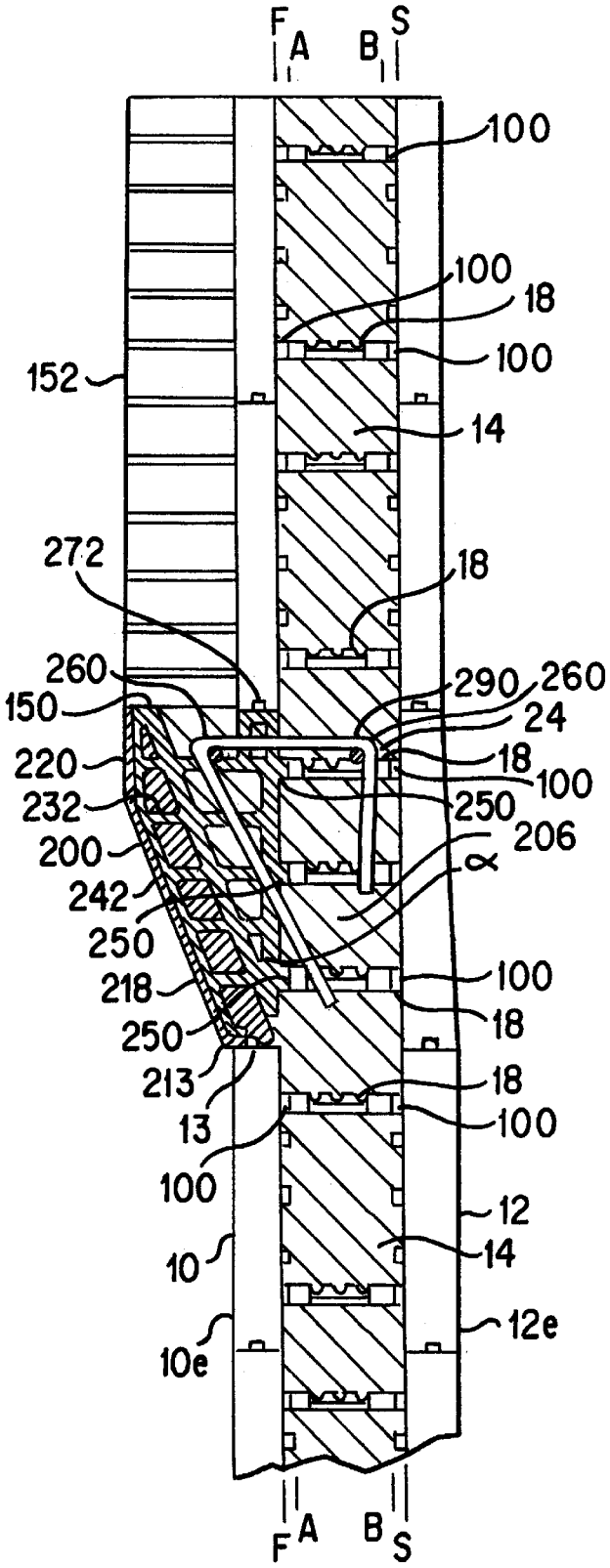
FIG. 8 is a cross-sectional view of a ledge panel assembly of the concrete form system used to fabricate a concrete wall having a weight bearing ledge surface, showing a re-enforcing re-bar providing additional structural support to the ledge panel assembly.
Figure 9:
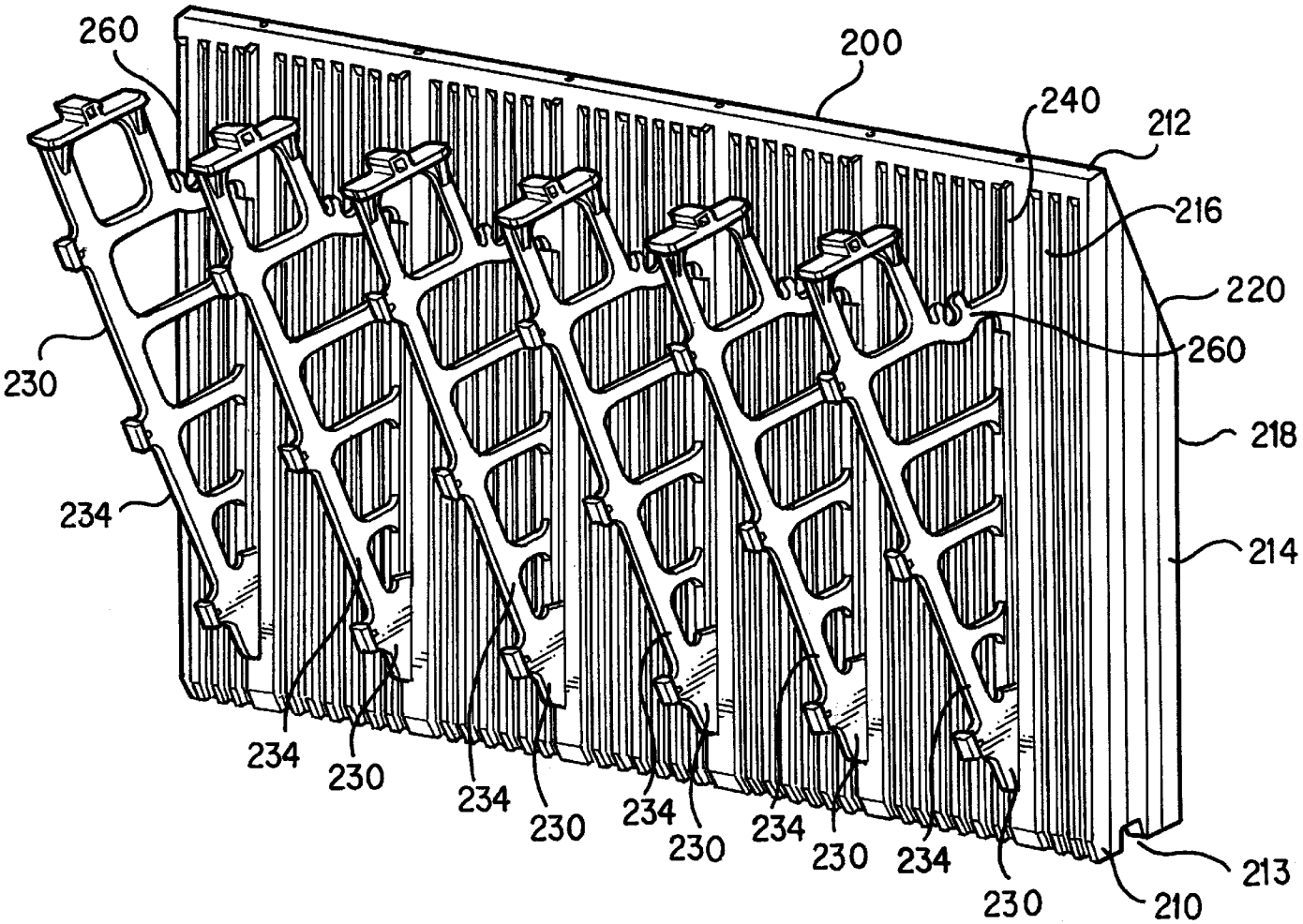
FIG. 9 is a perspective view of a ledge panel assembly of the concrete form system shown in FIG. 8.
Figure 10:
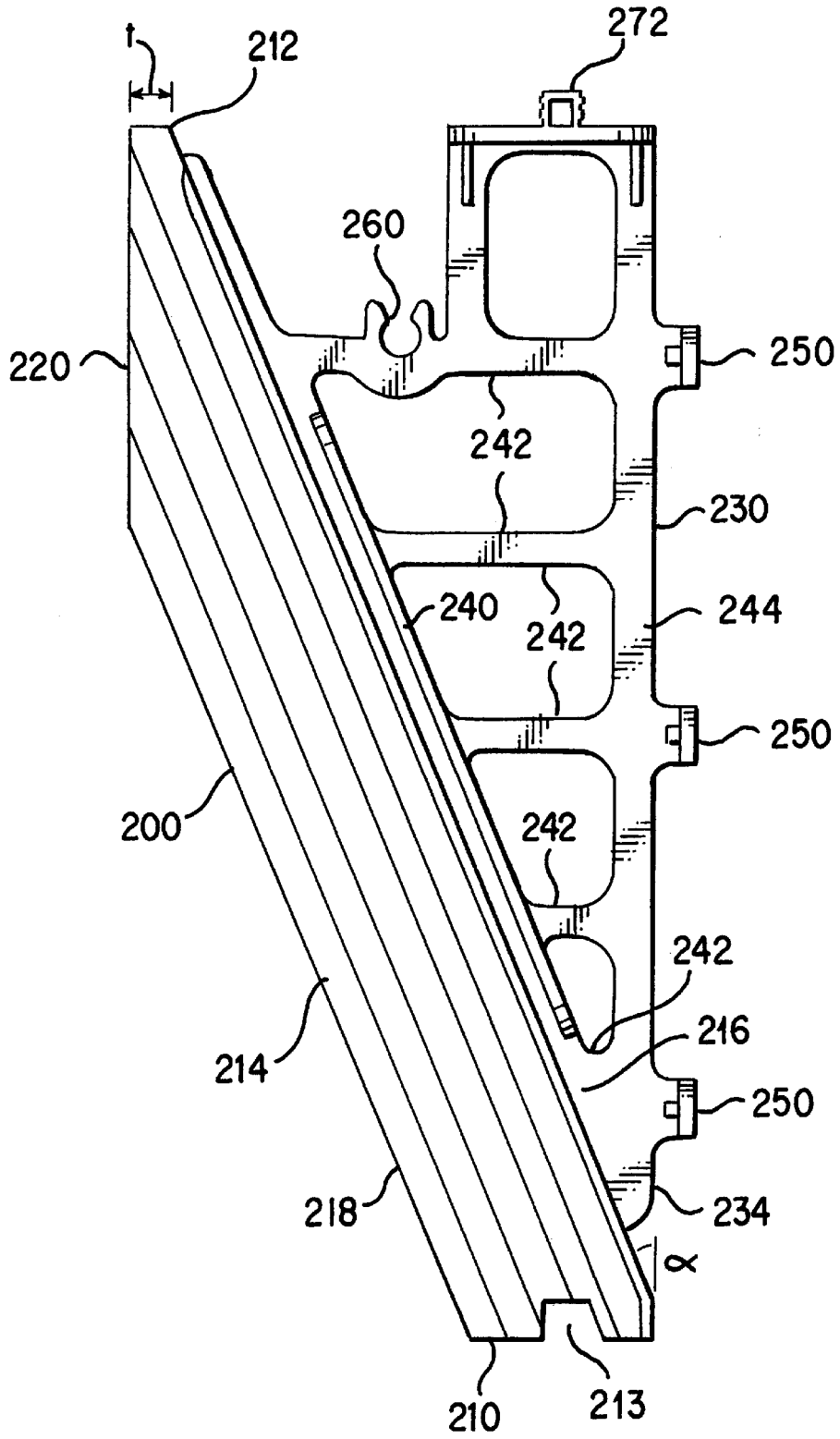
FIG. 10 is a side view of the ledge panel assembly shown in FIG. 9.

With reference to FIGS. 8–13, the present invention provides for the fabrication of a concrete structure having one or more bearing surfaces such as for example, a brick-ledge 150 for supporting a brick fascia 152, a shelf 154 for supporting a floor system 156 or other structure. One or more ledge panel assemblies 200 are installed on a form panel 10, 12 according to the method described below, to form a ledge cavity 206, which is filled with concrete to form the bearing surface. FIGS. 9 and 10 show a preferred form of the ledge panel assembly 200 of the present invention in greater detail. In preferred form, the ledge panel assembly 200 generally comprises a ledge panel 208 having a lower edge 210, an upper edge 212, and a generally planar panel body 214 extending therebetween. The ledge assembly 200 is preferably constructed of high-density plastic. A first mounting coupling can be provided on the lower edge 210, for alignment and for more securely retaining the ledge panel assembly 200 on an underlying lower side panel 10,12. For example, the preferred embodiment of the first mounting coupling, as depicted in the figures, comprises a slot 213, for engaging a corresponding key 13, shown in FIGS. 2 and 8, provided on the top edge of the underlying lower side panel 10, 12. The key 13 and slot 213 can be provided with cooperating projections and recesses for more secure engagement.

The ledge panel 208 further comprises an interior face 216 and an exterior face 218. Similar to the side panels 10, 12 discussed above, the interior face 216 is preferably slotted or provided with other surface features to increase the available surface area on the interior face 216 to provide more secure bonding between the ledge panel 208 and the concrete. The exterior face 218 of the ledge panel 208 adjacent the upper edge 212 is preferably mitered with a plumb cut 220, whereby the upper edge 212 has a reduced thickness t, preferably of approximately ½ inches. In this manner, the apparent thickness of the panel 208 is minimized for improved aesthetics, while maintaining substantially the full thickness, strength and insulative capacity of the panel 208 throughout substantially the remainder of its length.

Figure 11:
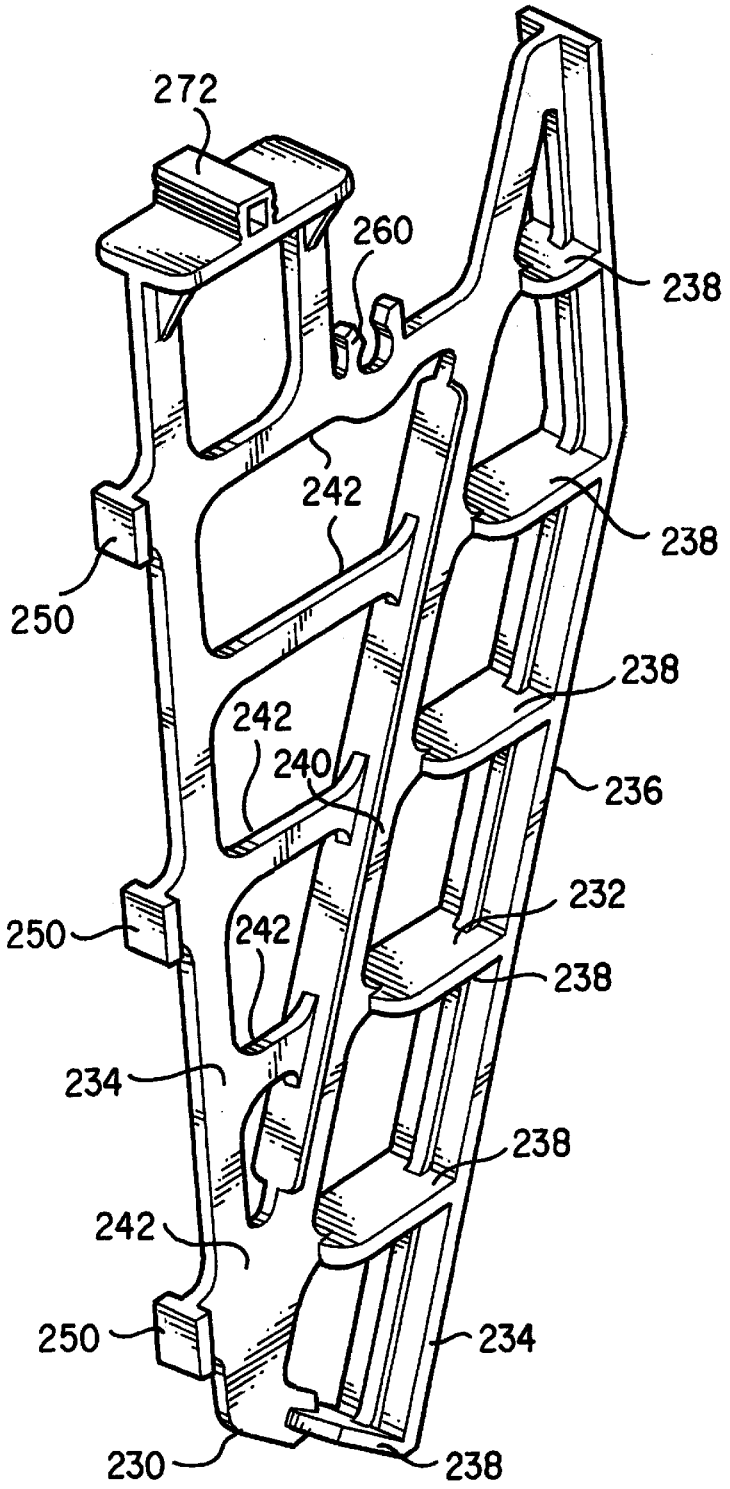
FIG. 11 is a perspective view of a ledge web member of the ledge panel assembly shown in FIG. 9.
Figure 12:
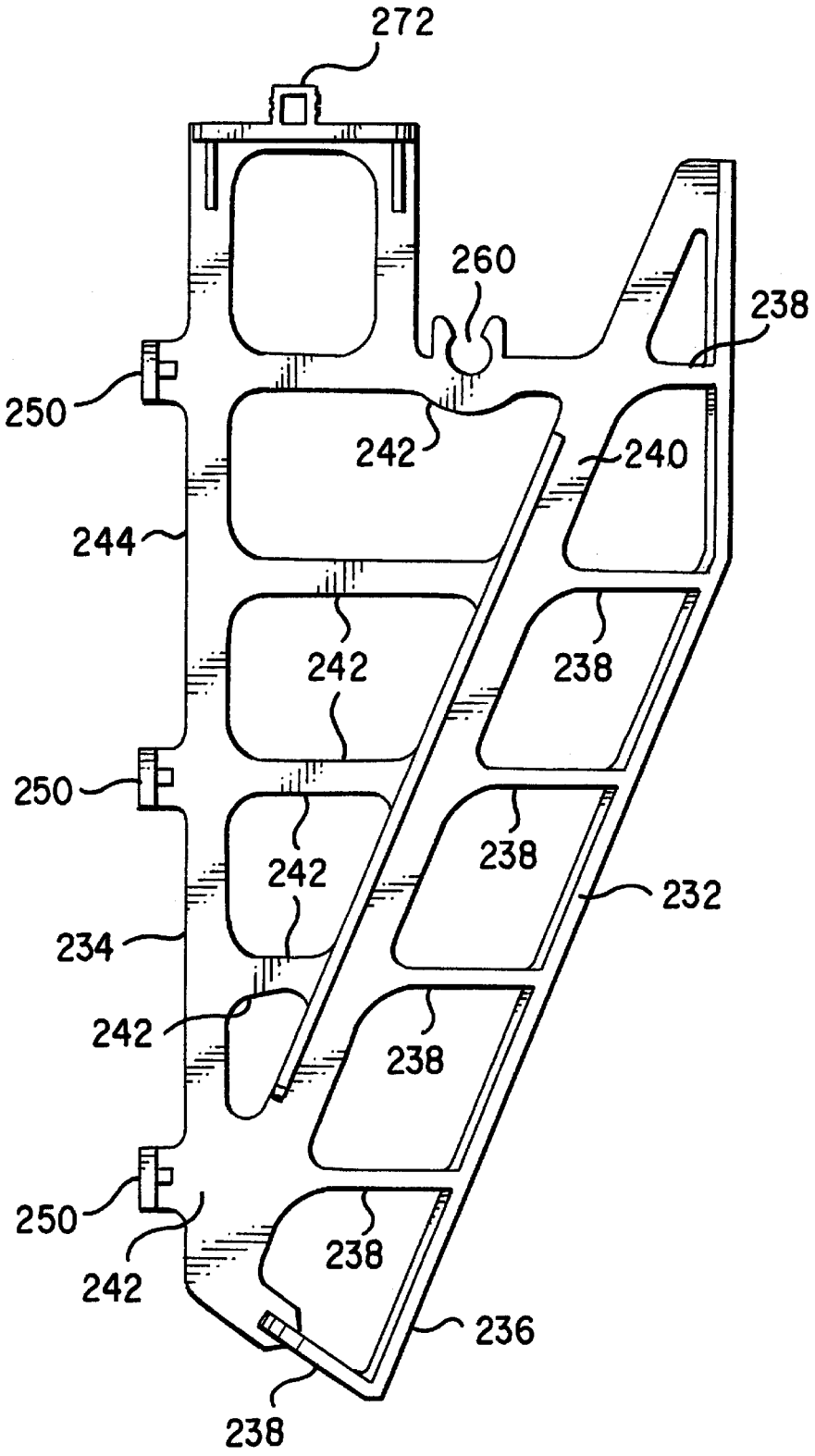
FIG. 12 is a side view of the ledge web member shown in FIG. 11.

The ledge panel assembly 200 preferably further comprises one or more ledge web members 230, shown in greater detail in FIGS. 10–12. Each ledge web member 230 preferably comprises an embedded portion 232 which is embedded or otherwise integrally formed within the panel body 214, and an exposed portion 234 extending outward of the panel body 214. The embedded portion preferably comprises a end plate 236, which is preferably embedded adjacent the exterior face 218 of the panel body 214. The ledge member end plate 236 provides structural strength to the panel body 214, and provides strapping for attachment of siding, wallboard, or other wall treatment. A plurality of struts 238, preferably approximately six, extend from the end plate 236, to support a medial flange 240, which is preferably embedded or otherwise integrally formed within the panel body 214 adjacent the interior face 216 of the panel body 214.

The exposed portion 234 of each ledge web member 230 preferably further comprises a plurality of support ribs 242 extending from the medial flange 240 to support an attachment flange 244. The attachment flange 244 preferably carries a generally linear array of ledge attachment couplings 250 formed from the portion of the ledge web member 230 that extends outward of the ledge panel 208 into the ledge cavity 206. The ledge attachment couplings 250 are preferably substantially similar to the attachment points 17 or 100 of the web members 16 or 90, respectively, described above and are capable of engagement with the connector couplings 20 of standard connectors 18. In the preferred embodiment depicted, the ledge panel assembly 200 has three spaced-apart ledge attachment couplings 250. It is also preferred that the ledge attachment couplings 250 of one ledge web member 230 be disposed in a substantially linear relationship with each other. That is, one ledge attachment coupling 250 is disposed above an adjacent ledge attachment coupling 250. Further, it is preferred that the ledge attachment couplings 250 of a ledge web member 230 are equally spaced apart.

As seen best with reference to FIGS. 8 and 10, the substantially linear array of ledge attachment couplings 250 are parallel to first plane F of the interior surface of the first side panel 10. Further, it is preferred that the attachment couplings of the side panel upon which the ledge assembly 200 is mounted and the ledge attachment couplings of the ledge assembly 200 are generally disposed in the same plane. This allows the attachment couplings of opposed side panels 10, 12 and the ledge attachment couplings 250 and attachment coupling of opposed side panel(s) 10, 12 to be spaced a predetermined distance apart. As one skilled in the art will appreciate, by spacing the respective attachment couplings and ledge attachment couplings the predetermined distance apart, a selected length connector, and/or connector link, may be used to bridge the gap between the respective opposing attachment couplings and ledge attachment couplings.

The generally linear array of the ledge attachment couplings 250 of the ledge web members 230 preferably forms an acute angle α with the panel body 170. The exposed portion 234 of the ledge web member 230 preferably further comprises one or more ledge apertures 260 for engaging a generally horizontal, longitudinally extending, span of re-bar. It is preferred that the ledge aperture 260 is formed in the upper surface of the uppermost support rib 242 of the ledge assembly 200. In use, the span of re-bar is extended through the aperture 260 of each of the ledge web members 230 of the ledge assembly 200. As shown in FIG. 8, the present invention contemplates reinforcing the ledge assembly with re-bar for increased structural strength of the formed ledge surface. Here, a second longitudinally extending span of re-bar is placed in a connector aperture 24 of a connector 18 so that the respective spans of rebar are parallel to each other and are co-planer. Subsequently, at least one hook shaped re-bar form 290 is set onto both the spans of re-bar so that the hook shaped re-bar form is disposed and secured within the ledge cavity 206. The re-bar is "locked" to the structure of the present invention within the ledge cavity 206 when the concrete sets within the cavity 206.

The ledge assembly 200 also preferably has a second mounting coupling for engaging an upper side panel 10, 12 of the concrete form system stacked above the ledge assembly 200. Preferably the second mounting coupling is formed on the exposed portion 234 of the ledge web member 230. The second mounting coupling preferably has a key shape 272 that is adapted to be complementarily mated into a slot within the lower edge of the side panel 10, 12 for alignment and more secure attachment between the ledge assembly 200 and the upper side panel 10, 12.

As seen best with reference to FIGS. 8 and 12, one or more ledge assemblies 200 are installed within the concrete form system by mounting the lower edge 210 of the ledge panel 208 onto the top of an underlying lower side panel 10, 12. For clarity, the arrangement of a single ledge assembly 200 installed onto the second side panel 12, in opposition to the side panel 10, will be described. It will be understood, however, that this arrangement can be repeated at various positions on the second side panel 12 to form multiple bearing surfaces. Also, one or more ledge assemblies 200 can be installed on the first side panel 10, in mirror image fashion. In this manner, opposed bearing surfaces can be formed at the same level, and or staggered at different levels, on both side panels 10, 12. If provided, the first mounting coupling of the ledge panel is engaged between the ledge assembly 200 and the side panel 12, for example, by engaging the slot 213 with a cooperating projection or key 13 provided on the top edge of the lower side panel 12 as shown in FIG. 1. The ledge attachment couplings 250 of the ledge assembly 200 are generally parallel to the first plane F of the first side panel 10, which is erected in opposition to the ledge assembly 100 (or generally parallel to the second plane S of the second side panel 12 if the ledge assembly is erected on the first side panel). More particularly, the ledge attachment points of the ledge assembly are generally aligned in the same plane A as the attachment points of the underlying second side panels 12 (or generally in plane B for ledge assemblies 200 installed on underlying first side panel 10). In this position, the ledge panel 208 will extend at the acute angle α, shown in FIGS. 8 and 10, outward from the plane A, or B, of the attachment points 17 or 100 in the direction of the exterior surface 12*e* of the side panel 12.

In the installed configuration of the ledge assembly 200, the struts 238 and the ribs 242 are preferably generally horizontally aligned, and the attachment flange 244 is generally vertical. The outward extension of the ledge panel 208, in opposition to the opposing side panel 10, forms the ledge cavity 206, which is filled with concrete to form the brickledge bearing surface or other bearing surface. One or more connectors 18 are engaged between ledge attachment couplings 250 of the ledge assembly 200, and the attachment points 17 or 100 of the opposed side panel 10.

Figure 13:
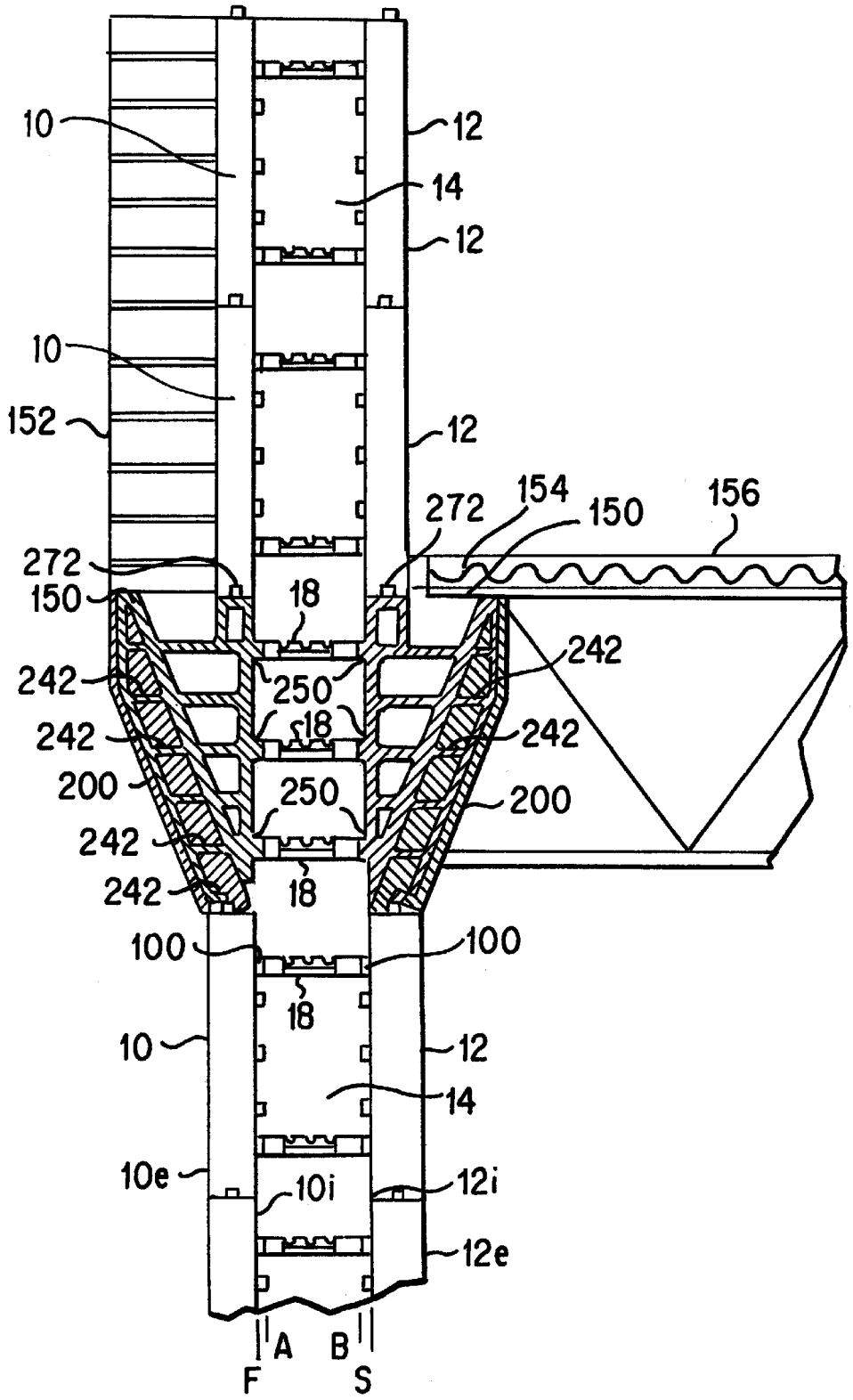
FIG. 13 is a side, cross-sectional view of two ledge panels assemblies on opposing sides of a concrete wall structure.

In the arrangement wherein first and second ledge panel assemblies 200 are installed opposite one another in each side panel 10, 12, respectively, as shown in FIG. 13, the connectors 18 are engaged between opposed ledge attachment points 250 of the first and second ledge panel assemblies 200 within the ledge cavity between the opposing first and second ledge panels 208. A single connector can directly engage attachment points 250 and attachment points 17 or 100 (or attachment points 250 of opposed first and second ledge assemblies 200), or if a thicker wall is desired, a first connector 18 can be attached to a first attachment coupling 250, a second connector 18 attached to a second attachment coupling 17 or 100 (or ledge attachment coupling 250), and one or more connector links (not shown) installed to couple the connectors 18.

One or more upper side panels 12 can be stacked above the ledge assembly 200 on the second mounting coupling of the ledge assembly 200. If provided, the ledge panel assembly 200 and the upper side panel 12 are engaged, for example, by engaging the key 272 in the cooperating slot provided in the bottom edge of the upper side panel 12, as shown in FIGS. 8 and 13. The key and slot configuration of the second mounting coupling of the ledge assembly can optionally be provided with interlocking projections and recesses for more secure attachment.

Thus described, the system of the present invention enables a method of fabricating a concrete structure having a ledge support surface. In preferred form, and described with reference to FIG. 8, the method of the present invention generally comprises the steps of erecting a first form panel 10 comprising an interior surface 10*i*, an exterior surface 10*e*, and a plurality of attachment points 17 (or 100) generally aligned along a plane A adjacent the interior surface 10*i*. The method preferably further comprises erecting a second form panel 12 comprising an interior surface 12*i*, an exterior surface 12*e*, and a plurality of attachment points 17 (or 100) generally aligned along a plane B adjacent the interior surface 12*i*, the interior surfaces 10*i*, 12*i* of the first and second form panels 10, 12 confronting one another and separated a distance to define a cavity 14 therebetween. The method preferably further comprises installing a ledge assembly 200 onto the upper surface of the lower second side panel 12, whereby the ledge attachment couplings 250 of the ledge assembly 200 are installed to be generally aligned along the plane B, and whereby the ledge panel 208 extends at an acute angle α from plane B in the direction of the exterior surface 12*e* of the second side panel 12 to define a ledge cavity 206 therebetween the ledge panel 208 and the opposing first side panel 10. The method preferably further comprises engaging a plurality of connectors 18 between the ledge attachment couplings 250 of the ledge assembly 200 and the attachment couplings 17 (or 100) aligned along plane B and the attachment points 17 (or 100) aligned along plane A. The method preferably further comprises substantially filling the cavity 14 between the first and second side panels 10, 12 and the ledge cavity 208 with concrete, and allowing the concrete to cure. The method may optionally also include the formation of additional ledge assemblies 200 or other bearing surfaces on the same or other surfaces of the concrete structure, in like manner. In this fashion, multiple brickledges or other bearing surfaces can be provided on either or both surfaces of the wall in like manner. A brick fascia 152, floor system 156, or other structures or materials can be installed on and supported by the ledge assembly 200.

The method and system of the present invention is advantageous, as the ledge assembly 200 or other bearing surface thereby provided is not interrupted by any portion of the EPS material typically used to construct the side panels 10, 12, and the ledge panel 208. Only the thin plastic support ribs 242 of the ledge web members 230 present interruptions in the concrete of the ledge assembly 200, and the cross-sectional area of these interruptions is minimal. Thus, a stronger bearing surface may be achieved. The system and method of the present invention are further advantageous as a majority of the forming components utilized are standard components, and need not be specially manufactured for the provision of brickledges or other bearing surfaces. This results in reduced cost and complexity. A further advantage of the present invention is the versatility provided by enabling fabrication of a wall having a bearing surface of virtually any desired incremental thickness, through the use of different length connectors, and/or the use of connector links coupling two or more connectors.

Figure 14:
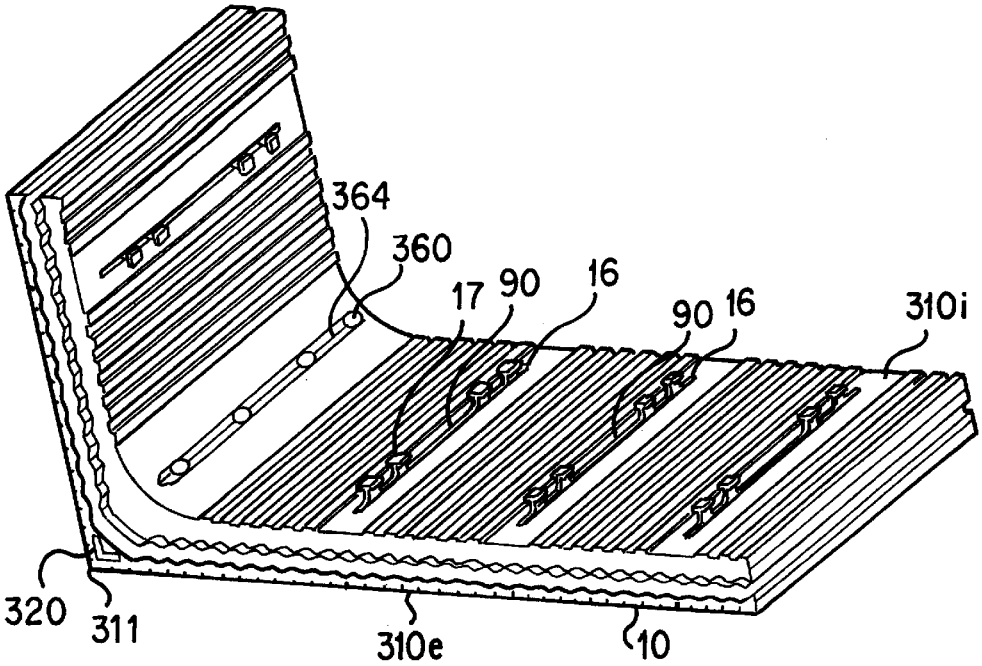
FIG. 14 is a perspective view of a first corner panel having a corner web member partially disposed and integrally formed within the first corner panel.
Figure 15:
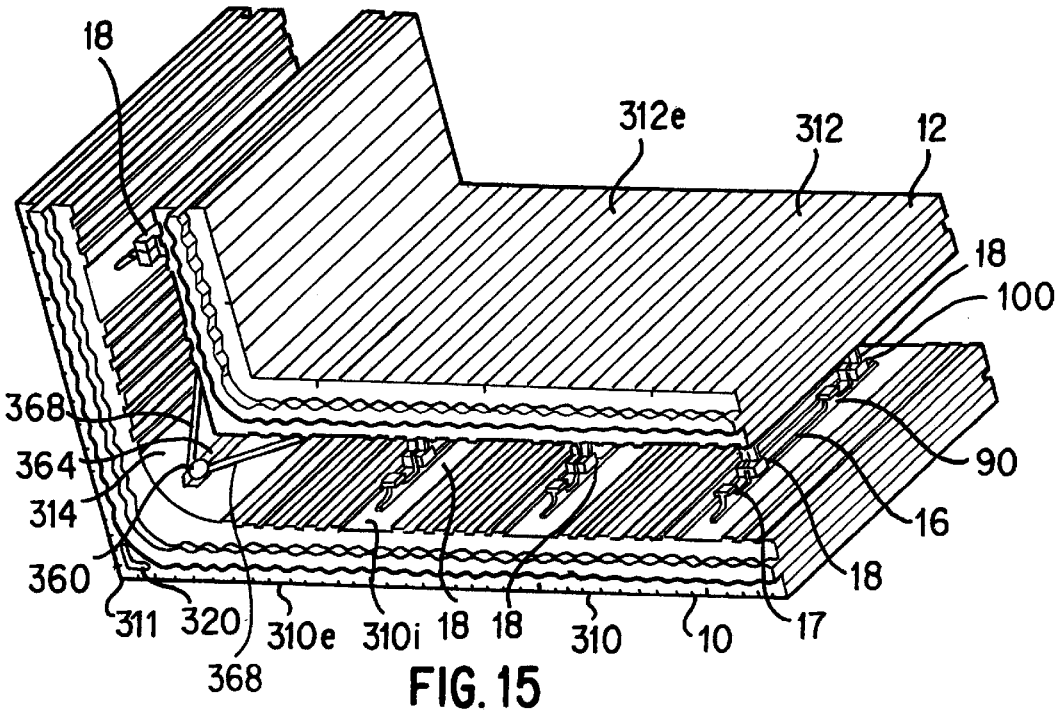
FIG. 15 is a perspective view of a first and second corner panel spaced apart and connected by a plurality of connectors between opposing attachment couplings extending from the first and second corner panels.

Referring now to FIGS. 14–19, the present invention may also provide a corner web member. As noted above, the side panels 10, 12 may be provided as corner panels of various angular displacements. For clarity in describing this embodiment of the invention, and as shown in FIGS. 14 and 15, the side panels 10, 12 will be called a first corner panel 310 and a second corner panel 312. It will be understood that the first corner panel 310 and the second corner panel 312 have the same properties as the side panels 10, 12 described above. That is, the first corner panel 310 has a first exterior surface 310*e*, an opposing first interior surface 310*i*. The two longitudinally-extending first side panels that form the first corner panel connect to form a substantially vertical corner panel edge 311 in the first exterior surface 310*e* of the first corner panel. Similarly, the second corner panel 312 has a second exterior surface 312*e*, an opposing second interior surface 312*i*, and is formed from two longitudinally-extending second side panels. As one skilled in the art will appreciate, and as shown in FIG. 15, a portion of the first interior surface 310*i* of the first corner panel 310 faces a portion of the second interior surface 312*i* of the second corner panel 312. Further, the first and second interior surface 310*i*, 312*i* are spaced apart a predetermined distance so that a cavity 314 of predetermined width is formed therebetween the interior surfaces 310*i*, 312*i*. As one skilled in the art will further appreciate, the corner panels 310, 312 may be connect to other longitudinally-extending side panels 10, 12 of the structure described above.

The corner panels 310, 312 are connected to each other by a bridging means. As shown in FIGS. 14 and 15, the bridging means preferably comprises the engaged combination of web members 16 or 90, and connectors 18, as described above. That is, the bridging means may comprise at least one web member 16 or 90 and at least one connector. Here, at least one web member 16 or 90 is partially disposed and integrally formed within each of the first and second corner panels 310, 312 and extends through the respective first and second interior surfaces 310*i*, 312*i* to form an attachment coupling 17 or 100 that is disposed within the cavity 314 between the first and second corner panels 310, 312. The connector is disposed within the cavity 14 in operative engagement with opposing attachment couplings 17 or 100 extending from the respective interior surfaces 310*i*, 312*i* of the corner panels 310, 312.

Figure 17:
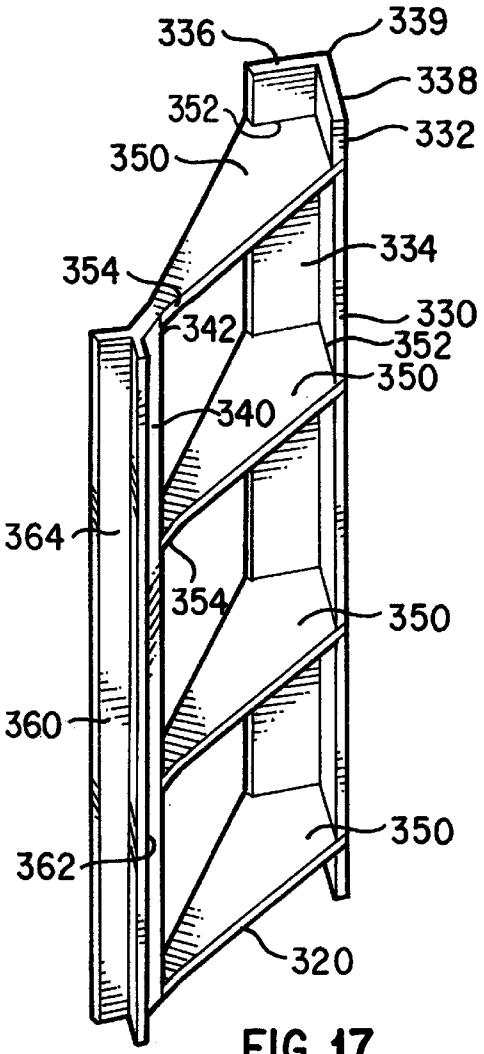
FIG. 17 is a perspective view of a preferred embodiment of a corner web member of the present invention.
Figure 16:
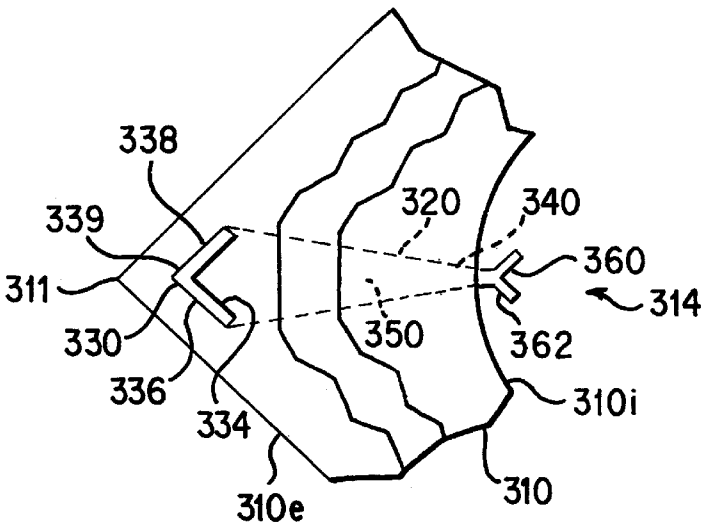
FIG. 16 is a cross-sectional view of a corner panel having a corner web member disposed therein.
Figure 18:
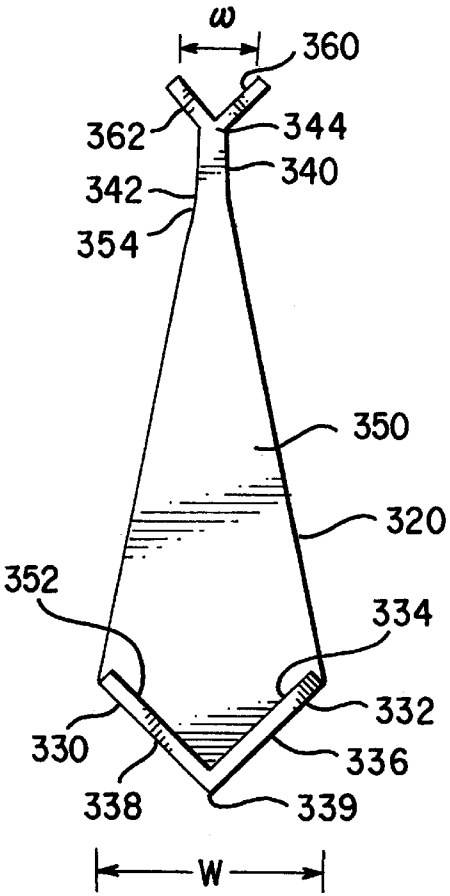
FIG. 18 is a top view of the corner web member of FIG. 17.
Figure 21:
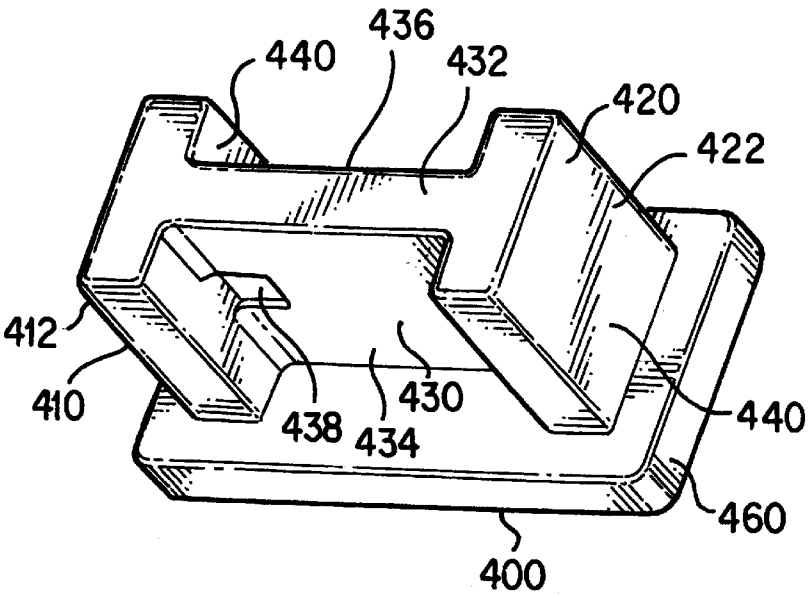
FIG. 21 is a perspective bottom view of the connector link shown in FIG. 20.
Figure 20:
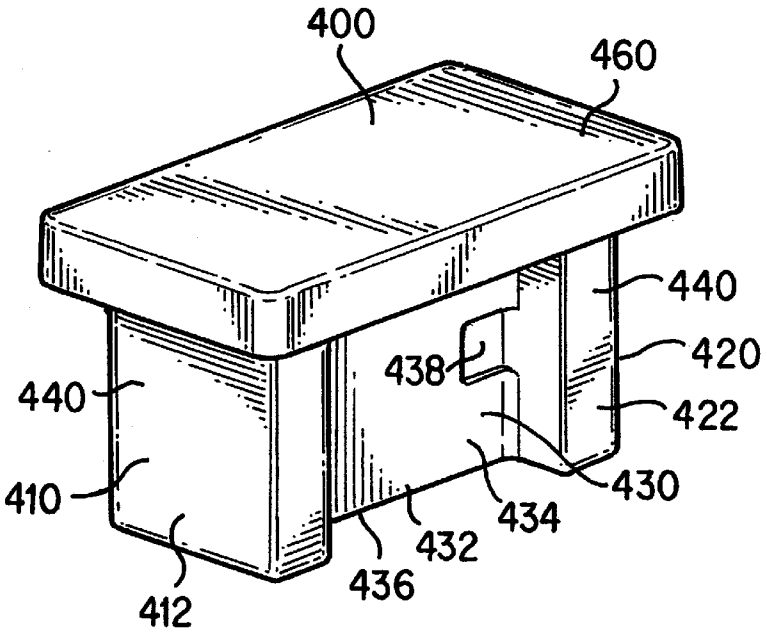
FIG. 20 is a perspective top view of a connector link component of the concrete form system of the present invention.
Figure 22:
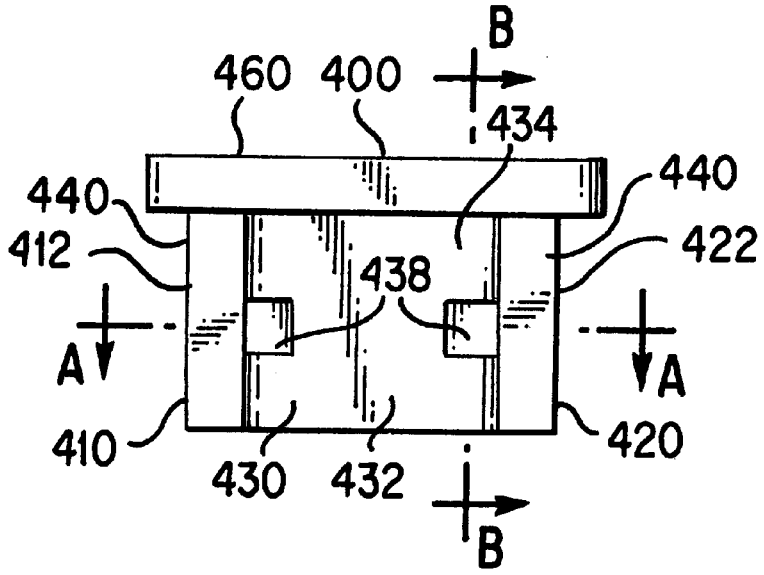
FIG. 22 is a side view of the connector link shown in FIG. 20.
Figure 23:
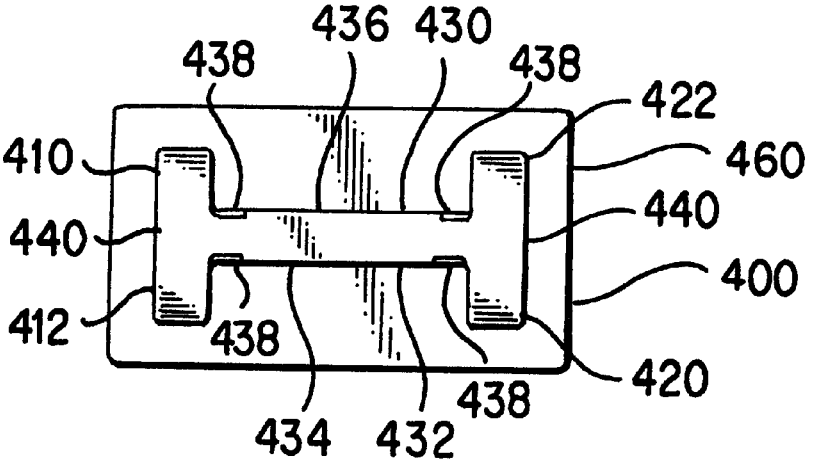
FIG. 23 is a bottom view of the connector link shown in FIG. 21.

A corner web member 320 may be provided within the first corner panel 310 to provide additional structural support of the outside corner of the formed insulated wall structure as well as to provide a strapping surface to connect siding and the like to the formed concrete wall. Referring now to FIGS. 16–18, the corner web member 320 is partially disposed and integrally formed within the first corner panel. To enhance the bond between the first side panel 310 and the concrete poured within the cavity 314, a portion of the corner web member extends through the first interior surface 310*i* of the first corner panel into the cavity 314. That is, since the corner web member 320 is both an integral part of the first corner panel 310 and extends into the cavity 314, it allows the first corner panel 310 to "lock" to the concrete once the concrete is poured and cures within the cavity 314.

The corner web member 320 preferably comprises a corner flange member 330, a bridging member 340, and a plurality of spaced-apart support struts 350 connecting the corner flange member 330 to the bridging member 340. Preferably, the corner flange member 330 has an upper surface 332, an opposed lower surface 334 and is formed from a longitudinally-extending first leg 336 connected to a longitudinally extending second leg 338. The connected first and second legs 336, 338 form a corner flange edge 339 in the upper surface 332 of the corner flange member 330. The bridging member 340 has a top edge 342 and an opposed bottom edge 344. Each support strut 350 has a proximal end 352, an opposed distal end 354 and a longitudinaly-length therebetween. For structural support of the corner web member 320, the proximal end 352 of each support strut 350 is connected to the lower surface 334 of the corner flange member 330 and the distal end 354is connected to the top edge 342 of the bridging member 340. It is preferred that the support struts 530 are spaced a predetermined distance apart from each other.

When a portion of the corner web member 320 is embedded within the first corner panel 310, as best shown in FIG. 16, the corner flange member 330 and the proximal end 352 of each support strut 350 is preferably completely disposed within the first corner panel 310. That is, as best shown in FIG. 16, the corner flange member 330 is located slightly below the exterior surface of, or recessed within, the first corner panel 310, preferably at a distance of approximately one-quarter (¼) on an inch from the exterior surface 310*e*. Alternatively, the corner flange member 330 may abut the exterior surface 310*e* of the first corner panel 310. It is also preferred that the corner flange member 330 is oriented substantially upright and disposed substantially parallel to the exterior surface 310*e* of the first corner panel 310. In this orientation, the corner flange edge 339 of the corner flange member 330 is disposed substantially parallel to the corner panel 311 edge of the first corner panel 310. For example, the first corner panel 310 and the corner flange member 330 may both have an "L" shape in cross-section, which allows the upper surface 332 of the corner flange member 330 to be substantially parallel to the exterior surface 312*e* of the first corner panel 310 when the corner flange edge 339 of the corner flange member 330 is disposed substantially parallel to the corner panel edge 311 of the first corner panel 310. The corner flange member 330 is thus preferably adapted to receive and frictionally hold a metal fastener, such as a nail or screw, therein, thus providing "strapping" for a wall system that allows attachment of gypsum board (not shown), interior or exterior wall cladding (not shown), or other interior or exterior siding or wall treatment (not shown).

Figure 19:
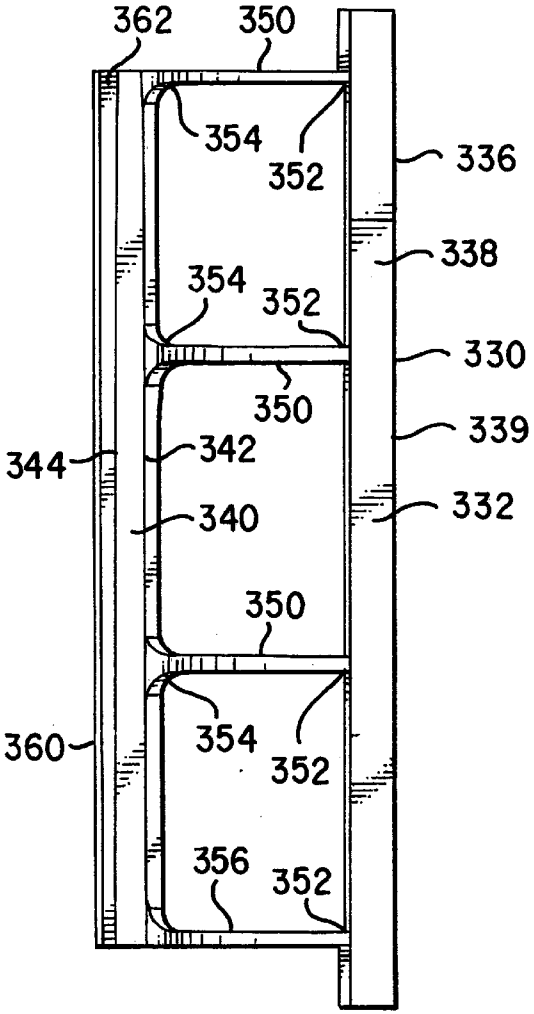
FIG. 19 is a side view of the corner web member of FIG. 17.

Referring now to FIGS. 17–19, the plurality of support struts 350 of the corner web member 320 preferably extends generally perpendicular to the corner flange member 330 and the bridging member 340. This generally perpendicular arrangement of the support struts 350 with respect to both the corner flange member 330 and the bridging member provides increased strength and resistance to outward pressures as concrete is poured within the cavity 314. As best seen in FIG. 18, the corner flange member 330 preferably has a first width W and the bridging member 340 has a second width w that is less than the first width. The proximal end 352 of each support strut 350 preferably has a width approximately equal to the first width of the corner flange member 330 and the distal end 354 of each support strut 350 has a width approximately equal to the second width of the of the bridging member 340. Thus, each support strut 350 preferably tapers from the proximal end 352 to the distal end 354.

A support flange member 360 can also be provided in the corner web member 320 for additional surface area for locking the set concrete to the first corner panel 310 and for providing structural support for the corner web member 320. Referring to FIGS. 16–19, the support flange member 360 preferably comprises a top surface 362 that is connected to the bottom edge 344 of the bridging member 340. As one skilled in the art will appreciate, the support flange member is spaced apart from the interior surface 310*i* of the first corner panel 310 and is thus disposed within the cavity 314. It is preferred that the top surface of the support flange member 360 is oriented substantially parallel to the first interior surface 310*i* of the first corner panel 310. It is also preferred that the support flange member 360 have a cross-sectional shape similar to the corner flange member 330. That is, if the corner flange member has an "L" shape cross-section, the support flange member should also have an "L" shape cross-section. As best shown in FIGS. 16 and 18, the support flange member 360 is preferably smaller than the corner flange member 330.

Referring back to FIGS. 14 and 15, the support flange member 360 preferably also has a bottom surface 364 that forms at least one attachment point 366. The attachment point 366 is adapted to connect a support line 368, such as a tie wire or a plastic strap for example, to one attachment coupling 17 or 100 of the closest web member 16 or 90 in the second corner panel 312. By connecting the corner web member 320 to the attachment couplings 17 or 100 within the opposing second corner panel, the corner structure of the concrete form system is advantageously structurally reinforced. Preferably, an as shown in FIG. 14, the corner web member 320 has an attachment point 366 formed in the bottom surface 364 of the support flange member 360 proximate the distal end 354 of each of the support struts 350. Thus, in the example shown, the corner web member 320 comprises four attachment points 366.

The corner web member 320 is preferably formed as an integral component, preferably constructed of plastic, and more preferably high-density plastic such as polyethylene, although polypropylene or other suitable polymers may be used. Factors used in choosing the material include the desired strength of the corner web member 320 and the compatibility of the material of corner web member 320 with the material used to fabricate the first side panel 310.

The present invention may also include a method of fabricating a concrete structure having corner portions having a corner web member 320 disposed in the outer wall of the concrete structure. In this method of using the concrete form system, a first and a second corner panel 310, 312 are erected so that a portion of the interior surface 310*i* of the first corner panel 310 faces, and is spaced apart from, a portion of the interior surface 312*i* of the second corner panel 312 so that a cavity 314 is formed therebetween. The first corner panel 310 has a corner web member 320 partially disposed and integrally formed within the first corner panel 310 so that a portion of the corner web member 320 extends through the interior surface 310*i* of the first corner panel 310 into the cavity 314 between the first and second corner panels 310, 312. The first and second corner panels 310, 312 preferably each have a plurality of attachment couplings 17 or 100 spaced apart from the interior surfaces 310*i*, 312*i* of the first and second corner panels 310, 312. Next, a connector 18 is attached to at least one opposing pair of attachment couplings 17 or 100 extending from the respective first and second side panels 310, 312. Finally, the cavity 314 therebetween the first and second corner panels is substantially filed with concrete and allowed to cure.

Referring again to FIGS. 1–3, each attachment coupling 17 (or 100 if the web member 90 is used) independently engages a cooperating connector coupling of a connector 18. In the embodiment depicted in the FIG. 3, the connector 18 includes connector couplings 20, 21 formed in the respective first and second ends of the connector 18. Each connector coupling 20, 21 comprises a generally rectangular channel track forming a notch 22, 23, arranged at the opposite first and second ends thereof, and separated by a longitudinally-extending body 25 having a length L. Connectors 18 are preferably provided in standard lengths of two inch increments, such as for example, two inches (2"), four inches (4"), six inches (6"), and eight inches (8"). The notches 22, 23 of the couplings 20, 21 of the connector 18 are of a size and shape to complementarily and removably engage the attachment couplings 17 or 100 of the side panels 10, 12 by slidably receiving the substantially rectangular and flat attachment points 17 or 100 therein. Channel shaped slots 26 formed in each end of the connector 18 allow clearance of the portion of the web member 16 or 90 that connects the web member 16 or 90 to the attachment coupling 17 or 100. One or more retaining shoulders 28 can be provided within the slots 26 of the connector 18 for engaging cooperating recesses 102 in the web members 16 or 90 for more secure attachment of the connector 18 to the respective attachment coupling 17 or 100. As one skilled in the art will appreciate, the connector couplings can take any of a number of alternate embodiments to provide cooperating engagement with the attachment couplings 17 or 100. For example, the connector couplings can comprise slots, channels, grooves, recesses, hooks, eyelets, twist couplings, compression couplings, snap couplings, or other coupling means for engaging the attachment couplings 17 or 100.

The present invention preferably further provides one or more connector links 400, or splicers, shown in preferred form in FIGS. 20–26. Each connector link 400 preferably comprises a proximal end 410, comprising a first link coupling 412, an opposed distal end 420, comprising a second link coupling 422, and a substantially rigid body portion 430 extending between the distal end 420 and the proximal end 410. The first and second link couplings 412, 422, are shaped similarly and preferably substantially match the configuration of the attachment couplings 17 or 100, so that the connector couplings of connectors 18 can interchangeably engage attachment couplings 17 or 100 and/or the connector link couplings 412, 422, depending upon the desired application.

In the depicted embodiment, each link coupling 412, 422 comprises a generally rectangular element 440 adapted for sliding engagement within notches 22, 23 of the connector 18. A rib 432 preferably extends between the opposing rectangular elements 440 to form the body portion 430, and is preferably adapted for sliding engagement within the slot 26 of the connector 18. The generally rectangular elements 440 of the connector link 400 are generally parallel to one another, with the rib 432 extending generally perpendicularly therebetween and connecting the approximate midpoints thereof. In this manner, as seen best in FIGS. 21 and 23, each link coupling 412, 422 can be described as generally "T" shaped in cross-section. As seen best with reference to FIGS. 20–23, the rib 432 preferably has a first face 434 and an opposite second face 436. Each face of the rib 432 is preferably provided with a recess 438 adjacent the rectangular element 440 of each link coupling 412, 422 to engage the corresponding retaining lug 28 of the connector 18 with a snap fit, to provide a positive locking action and prevent disengagement during the concrete pour.

The depicted embodiment of the connector link 400 preferably further comprises a base flange 460, comprising a generally rectangular panel lying in a plane generally perpendicular to the rectangular elements 440 and the rib 432 of the body portion 430. The base flange 460 lends additional strength and rigidity to the connector link 400.

The length of the connector link 40 is selected to cooperate with the length of standard connectors 18 and the extent of projection of the panel couplings from the internal face of the form panels, to result in a cavity width (and thereby a finished wall thickness) of standard dimension (i.e., two inch increments).

The connectors 18 and the connector links 400 are preferably constructed of plastic, and more preferably of high-density plastic such as polyethylene. Polypropylene or other plastics, as well as metals, and other natural and synthetic materials of construction providing suitable strength and rigidity may alternatively be utilized.

Figure 26:
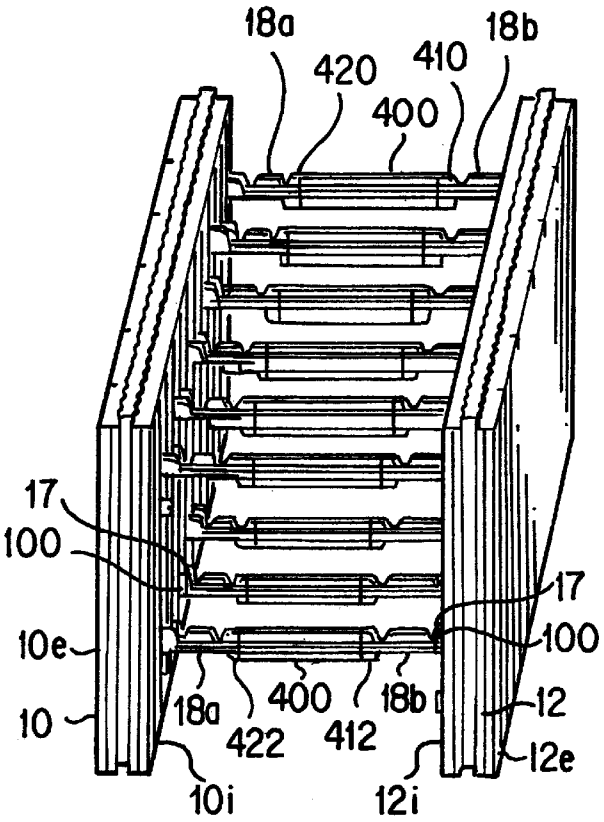
FIG. 26 is a perspective view of the connector link in use within the concrete form system according to a preferred embodiment of the present invention.
Figure 25:
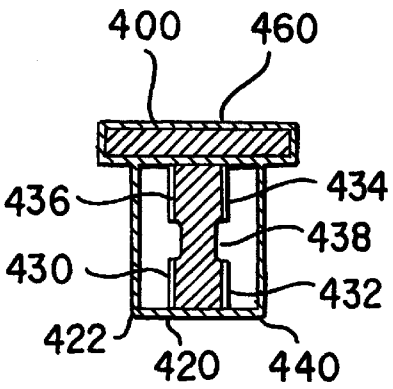
FIG. 25 is a sectional view of the connector link, taken at line 25—25 of FIG. 22.
Figure 24:
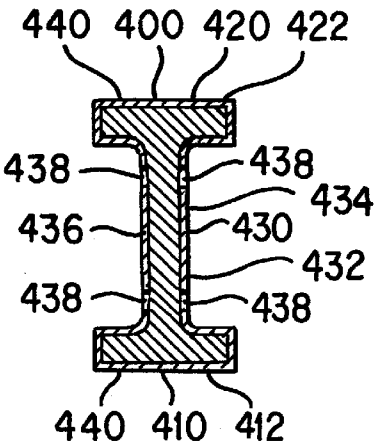
FIG. 24 is a sectional view of the connector link, taken at line 24—24 of FIG. 22.

The present invention provides a concrete form system enabling the formation of concrete walls or other components of various selected incremental thicknesses. With reference to FIG. 26, a preferred embodiment of the concrete form system of the present invention preferably comprises first and second side panels 10, 12, substantially as described above. Each of the first and second side panels 10, 12 comprises one or more attachment couplings substantially as described above, such as attachment points 17 or 100. A connector coupling 20 of the first end 27 of the one connector 18*a* engages one attachment coupling 17 or 100 of the first side panel 10, and a connector coupling 20 of the first end 27 of a second connector 18*b* engages one attachment coupling 17 or 100 of the second side panel 12. A connector link 40 is engaged between the first and second connectors, with its first and second link couplings engaging the connector couplings of the second ends 29 of the first and second connectors 18*a*, 18*b*. By combining connectors 18 and connector links 400 of selected lengths, a cavity 14 of any desired incremental width can be achieved.

Thus described, the system of the present invention enables a method of constructing a concrete structure. In preferred form, and described with reference to FIG. 26, the method of the present invention generally comprises the steps of erecting first and second form panels 10, 12, substantially as described above, whereby opposed interior faces of the first and second form panels 10, 12 form a cavity 14 therebetween. The method preferably further comprises engaging a first connector 18*a* with the first form panel 10, engaging a second connector 18*b* with the second form panel 12, and engaging a connector link 400 between the first connector 18*a* and the second connector 18*b*. By appropriate selection of the sizes of the first and second connectors 18*a*, 18*b* and the connector link 400, a cavity 14 of any desired incremental width can be achieved, thereby enabling the production of a wall or other component of any desired incremental thickness.

While the invention has been described in its preferred forms, it will be readily apparent to those of ordinary skill in the art that many additions, modifications and deletions can be made thereto without departing from the spirit and scope of the invention. For example, although the invention is described with reference to a preferred embodiment depicted in the figures, wherein a connector link 400 is engaged between two connectors 18*a*, 18*b*, with the connectors engaging the panel couplings, the present invention also comprehends systems and methods similarly incorporating a chain of three or more connectors 18 coupled by two or more connector links. Thus, using three connectors 18 that are eight inches in length, coupled with two connector links 400, the width of the cavity 14 would be approximately twenty-four inches.

Figure 27:
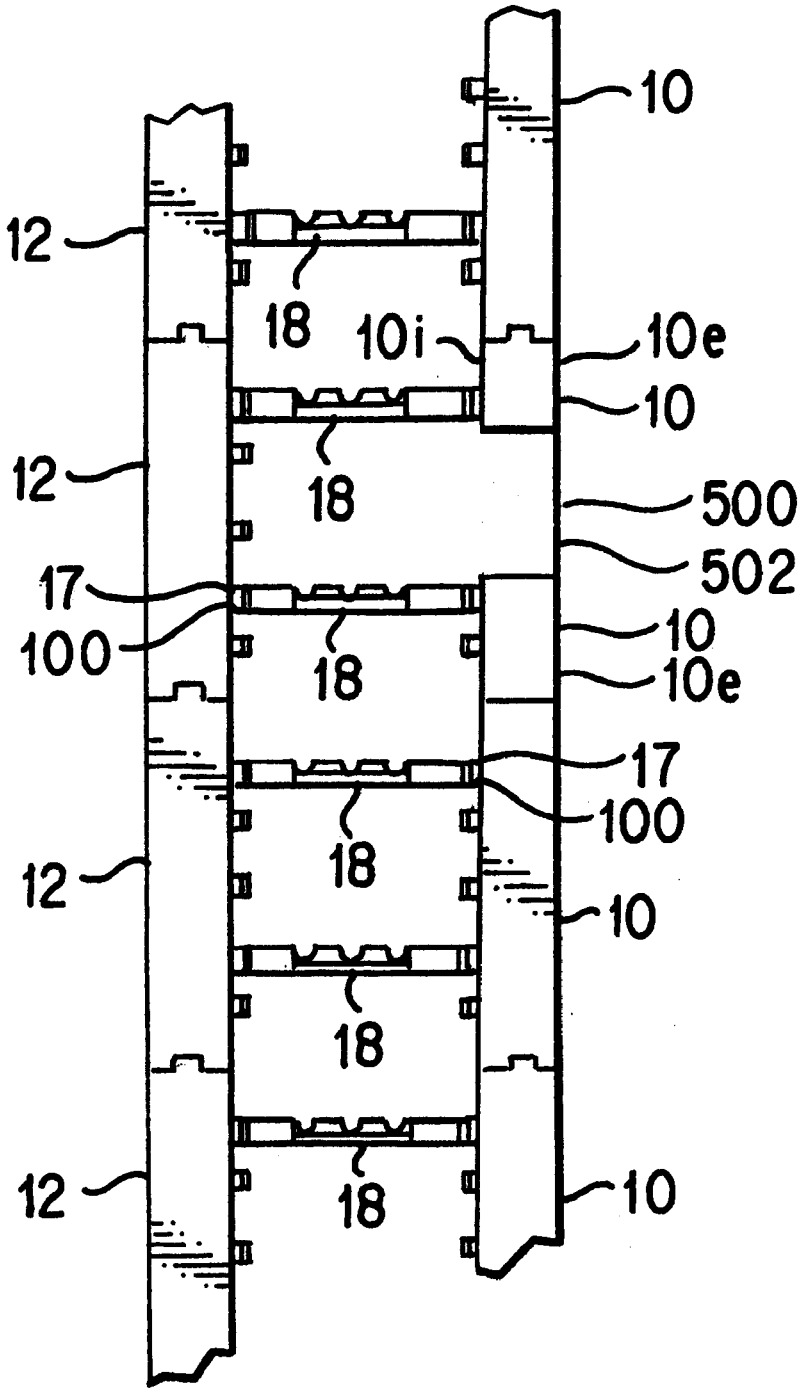
FIG. 27 is a side, cross-sectional view of a termite detection surface of the present invention showing the interior cavity between the respective side panels filled with concrete and the exposed surface of the cured concrete.

Further, the present invention provides for a method for constructing a concrete structure having a termite infestation detection surface 500. A termite detection surface is often required in construction of buildings because termites and other burrowing insects may burrow through the insulation material, such as the preferred EPS side panels 10, 12 of the present invention, or between the insulation material and the underlying structure to reach vulnerable construction materials above. To preclude the destruction of vulnerable materials, building code often requires the inclusion of a means of detecting the presence of termites or other such destructive pests. With reference to FIG. 27, a preferred embodiment of the concrete form system of the present invention preferably comprises first and second side panels 10, 12, substantially as described above. Each of the first and second side panels 10, 12 comprises one or more attachment couplings substantially as described above, such as attachment points 17 or 100. A connector 18, or any combination of connectors 18 and connector links 400 (not shown), operatively connects the first and second side panel 10, 12. One side panel 10 has a longitudinally extending length of set concrete that extends therethrough the side panel 10, and abuts the exterior surface 10*e* of the side panel 10. The exposed exterior surface 502 of the concrete preferably extends the entire longitudinal length of the side panel 10, and any abutting side panels 10, to form the termite infestation detection surface 500. As one skilled in the art will appreciate, because the cured concrete extends to and abuts the exterior surface 10*e* of the side panel 10, a crawling or burrowing insect is forced to traverse the exposed exterior surface, i.e., the termite infestation detection surface 500, in order to reach the portion of the concrete structure above the detection surface 500 and may thus be visually detected on the detection surface.

Figure 28:
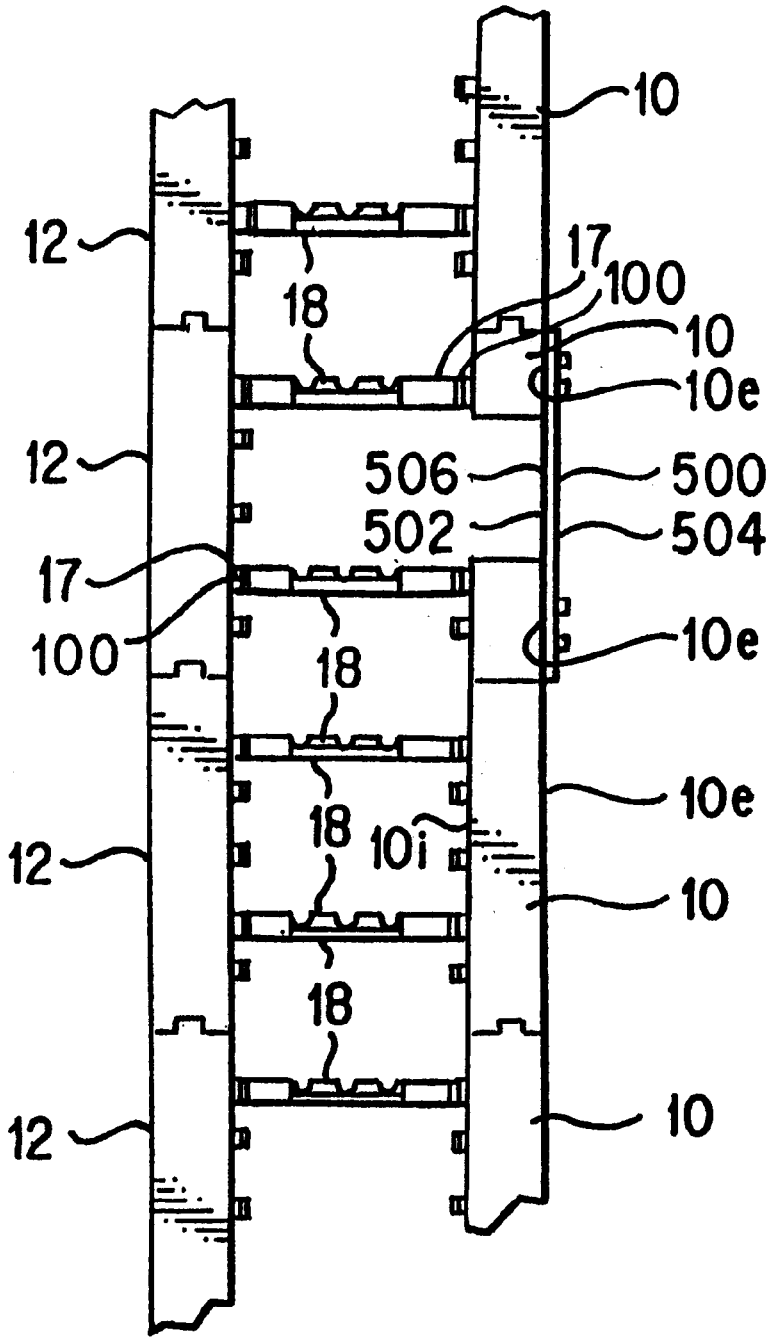
FIG. 28 is a side, cross-sectional view of a termite detection surface showing a support panel affixed to the exterior surface of one side panel and the interior cavity between the respective side panels filled with concrete.

Thus described, the system of the present invention enables a method of constructing a concrete structure with a termite infestation detection surface 500. In preferred form, and described with reference to FIGS. 27 and 28, the method of the present invention generally comprises the steps of: providing a first and second side panels 10, 12, substantially as described above; providing a longitudinally-extending support panel 504 having support panel interior surface 506 and having a first width that is less than the width of the first side panel 10; detachably securing the support panel 504 to the exterior surface 10*e* of the side panel 10 so that the interior surface 506 of the support panel 504 overlies the exterior surface 10*e* of the side panel 10. The method further comprises the steps of removing a longitudinally-extending strip of the side panel 10*s*, the strip having a width that is less than the first width of the support panel 504, to thus expose a portion of the interior surface 506 of the support panel 504, which allows the support panel 504 to be retained in contact with the exterior surface 10*e* of the side panel 10 during a concrete pour into the cavity 14.

Still further, the method comprises the steps of erecting the first and second side panels 10, 12, substantially as described above, whereby the interior surface 10*i* of the first side panels 10 and the exposed portion of the interior surface 506 of the support panel 504 oppose the interior surface 12*i* of the second side panels 12 to form a cavity 14 therebetween; detachably engaging a connector 18 to the opposing attachment couplings 17 or 100 within the opposed side panels 10, 12, and pouring concrete into the cavity 14 formed between the side panels 10–12 to be cured therein. As one skilled in the art will appreciate, the poured concrete will fill the cut out portion of the side panel 10 and will abut the exposed portion of the interior surface of the support panel 504 so that the poured concrete will be constrained substantially flush with the exterior surface 10*e* of the side panel 10. The method preferably further comprises removing the support panel 504 from the exterior surface 10*e* of the side panel 10 after the concrete has cured to expose the exterior surface 502 of the cured concrete. Thus, a longitudinally-extending termite infestation detection surface 500 is formed.

Although the present invention has been described with reference to specific details of certain embodiments thereof, it is not intended that such details should be regarded as limitations upon the scope of the invention except as and to the extent that they are included in the accompanying claims. For example, although the present invention is described with reference to a preferred embodiment incorporating the depicted concrete form system, it will be understood by those of ordinary skill in the art that the present invention is applicable to other types of concrete form systems utilizing one or more form panels or other concrete retaining and/or molding elements retained in position by one or more connectors or other relative position-fixing elements. Also, although the present invention is described with reference to a system, method and components thereof for use in the forming of concrete building components, the present invention may also find application in the formation of various other types of products of concrete and/or other moldable and curable materials such as, for example, structural and non-structural building components and consumer products of concrete, plastics, and other synthetic and natural materials.

What is claimed is:

1. An insulated concrete form system, comprising:

a) first and second longitudinally-extending panels, each panel having an exterior surface and an opposed interior surface, wherein a portion of the interior surface of said first panel faces a portion of the interior surface of said second panel, wherein said interior surfaces are spaced apart from each other so that a cavity is formed therebetween;

b) a plurality of web members, at least one web member partially disposed and integrally formed within a respective one of each of said first panel and said second panel so that a portion of each of said web members extends through the respective interior surfaces of said first panel and said second panel, wherein an attachment coupling is formed from the portion of each web member extending from the respective interior surfaces of said first panel and said second panel, wherein the attachment couplings of said respective web members are disposed within the cavity between said first and second panels and spaced apart from the interior surfaces of said first and second panels;

c) at least two connectors, disposed within the cavity between said first panel and said second panel, each connector having a first end, an opposed second end, a first length extending therebetween, and a pair of opposed connector couplings, wherein one connector coupling is formed in the first end of the connector and the other connector coupling is formed in the second end of the connector, and wherein the connector coupling of the first end of one connector is adapted to engage one attachment coupling of said first panel and the connector coupling of the first end of the second connector is adapted to engage one attachment coupling of said second panel so that the connector couplings of the second ends of the two connectors are spaced apart from, and oppose, each other within the cavity; and d) a connector link, disposed within the cavity between two opposing connectors, having a proximal end having a first link coupling, a distal end having a second link coupling, and a second length extending therebetween, wherein the first link coupling of said connector link is adapted to engage the connector coupling of the second end of one connector and the second link coupling of said connector link is adapted to engage the connector coupling of the second end of one other opposing connector.

2. The insulated concrete form system of claim 1, wherein the attachment couplings are oriented substantially upright within the cavity between said first and second panels, wherein the attachment couplings of the respective web members partially disposed and integrally formed within each of said first and second panels are spaced apart from each other within the cavity to form at least one pair of opposed attachment couplings, wherein each pair of opposed attachment couplings of said web members are longitudinally spaced apart a predetermined distance from each other, and wherein said connector link is operatively engaged to two said connectors operatively engaged to one pair of opposed attachment couplings to span the predetermined distance between the attachment couplings.

3. The insulated concrete from system of claim 1, wherein said connector link is selected from a plurality of connector links, wherein at least one connector link has a different length from said other connector links.

4. The insulated concrete form system of claim 3, wherein said connectors are selected from a plurality of connectors, wherein each connector has a different length from said other connectors.

5. The insulated concrete form system of claim 1, wherein said connector and said connector link are constructed of high-density plastic.

6. A connector link for use in an insulated concrete form system having first and second side panels and at least two connectors, each side panel having an exterior surface, an opposed interior surface, and at least one attachment coupling, the panels arranged in spaced parallel relationship with their interior surfaces and attachment couplings facing each other so that a cavity is formed therebetween, each connector having a first end and a distal second end, a first length extending therebetween, and a pair of opposed connector couplings, one connector coupling formed in the first end and the other connector coupling formed in the second end, so that the each connector coupling of each connector is adapted to engage one attachment coupling of the side panel, the connector link comprising:

a) a proximal end having a first link coupling for engagement to the connector coupling of one connector of the concrete form system;

b) a distal end having a second link coupling for engagement to the connector coupling of one other connector of the concrete form system; and c) a substantially rigid body portion extending between said proximal end and said distal end of said connector link, wherein the connector link is operatively engaged to the connectors to structurally connect one attachment coupling on one side panel to one other attachment coupling on the other side panel.

7. The connector link of claim 6, wherein said connector link is selected from a plurality of connector links, wherein at least one connector link has a different length from said other connector links.

8. The connector link of claim 6, wherein said connector link is constructed of high-density plastic.

9. The connector link of claim 6, wherein the connector coupling of the connector defines a rectangularly shaped notch having a channel shaped slot, and wherein each of said first link coupling and said second link coupling of said connector link has a generally rectangular element adapted for sliding engagement with the notch within the connector coupling.

10. The connector link of claim 9, wherein said body portion of said connector link is formed from a rib extending between the rectangular elements of said first link coupling and said second link coupling, and wherein the rib is adapted for sliding engagement within the slot in the connector coupling.

11. The connector link of claim 10, wherein the rectangular elements of said first link coupling and said second link coupling are generally parallel to each other, and wherein the rib of said connector link extends generally perpendicular therebetween to connect the approximate mid-points thereof so that said first link coupling and said second link coupling are generally "T" shaped in cross-section and so that said first link coupling, said second link coupling and said body portion are generally "I" shaped.

12. The connector link of claim 10, wherein the rib of said connector link has a first face and an opposing second face, wherein the connector link further comprises a plurality of recesses, each recess disposed adjacent each rectangular element of said first link coupling and said second link coupling, wherein each recess is adapted to engage a complementarily shaped lug in each of the connector couplings of the connectors of the concrete from system so that said connector link may be positively locked to the connectors to prevent disengagement during a concrete pour within the cavity.

13. The connector link of claim 10, wherein said rib of said connector link further comprises a base flange member connected to the rectangular elements of said first and second link couplings and the rib of said body portion, wherein said base flange member lies in a plane generally perpendicular to the rectangular elements and the rib.

14. The connector link of claim 13, wherein said base flange member has a generally rectangular shape.

15. A method of constructing a concrete structure, comprising the steps of:

a) erecting a first and second side panels, each side panel having an exterior surface, an opposed interior surface, and at least one attachment coupling, the panels arranged in spaced parallel relationship with their interior surfaces and attachment couplings facing each other so that a cavity is formed therebetween;

b) providing a first and a second connector, each connector having a first end, a distal second end, a first length extending therebetween, and a pair of opposed connectors couplings, wherein one connector coupling is formed therein the first end and the other connector coupling is formed therein the second end;

c) engaging the connector coupling of the first end of the first connector to one attachment coupling of the first side panel;

d) engaging the connector coupling of the first end of the second connector to one attachment coupling of the second side panel;

e) attaching a connector link to the connector coupling of the second end of the first connector and to the connector coupling of the second end of the second connector, each connector link having a proximal end having a first link coupling for engagement to the connector coupling, a distal end having a second link coupling for engagement to the connector coupling, and a substantially rigid body portion extending between said proximal end and said distal end of said connector link; and f) pouring concrete into the cavity formed between said side panels to be cured therein.

* * * * *